US009573658B2

(12) United States Patent
Murray, III et al.

(10) Patent No.: US 9,573,658 B2
(45) Date of Patent: Feb. 21, 2017

(54) MODULAR WATERCRAFT

(71) Applicant: J.P. Murray Company Inc., Newburgh, NY (US)

(72) Inventors: John P Murray, III, New York, NY (US); Justin M Bruyn, Newburgh, NY (US)

(73) Assignee: J.P. Murray Company Inc., Newburgh, NY (US)

( * ) Notice: Subject to any disclaimer, the term of this patent is extended or adjusted under 35 U.S.C. 154(b) by 0 days.

(21) Appl. No.: 14/210,844

(22) Filed: Mar. 14, 2014

(65) Prior Publication Data

US 2014/0318435 A1 Oct. 30, 2014

Related U.S. Application Data

(60) Provisional application No. 61/791,712, filed on Mar. 15, 2013, provisional application No. 61/927,769, filed on Jan. 15, 2014.

(51) Int. Cl.

| | |
|---|---|
| ***B63B 3/08*** | (2006.01) |
| ***B63H 21/30*** | (2006.01) |
| ***B63B 7/04*** | (2006.01) |
| ***B63B 35/71*** | (2006.01) |
| ***B63H 21/00*** | (2006.01) |

(52) U.S. Cl.
CPC . *B63B 3/08* (2013.01); *B63B 7/04* (2013.01); *B63B 35/71* (2013.01); *B63H 21/24* (2013.01); *B63H 21/30* (2013.01)

(58) Field of Classification Search
CPC ..... B63B 7/04; B63B 7/06; B63B 35/71; B63B 3/00; B63B 3/08; B63B 17/00; B63B 35/00; B63H 5/00; B63H 5/14; B63H 19/00; B63H 19/02; B63H 21/30
USPC ..... 114/347, 352, 354, 77 R
See application file for complete search history.

(56) References Cited

U.S. PATENT DOCUMENTS

| | | | | |
|---|---|---|---|---|
| 1,449,222 | A * | 3/1923 | Goethel | 114/352 |
| 3,822,427 | A * | 7/1974 | Ewart, Jr. | B63B 7/04 114/352 |
| 5,481,997 | A * | 1/1996 | Arndt | 114/347 |
| 6,482,056 | B1 | 11/2002 | Schell-Tomczak | |
| 6,619,224 | B1 * | 9/2003 | Syfritt | B63B 7/06 114/352 |
| 7,395,773 | B1 * | 7/2008 | Finefield | 114/352 |
| 7,963,243 | B2 * | 6/2011 | Quigley | 114/347 |
| 2002/0195039 | A1 * | 12/2002 | Anderson | 114/347 |

FOREIGN PATENT DOCUMENTS

| | | | |
|---|---|---|---|
| GB | 2353005 | A | 2/2001 |
| WO | 2013163445 | A1 | 10/2013 |

OTHER PUBLICATIONS

International Search Report and Written Opinion for corresponding application No. PCT/US14/27276, dated Jul. 24, 2014.

* cited by examiner

*Primary Examiner* — Lars A Olson
(74) *Attorney, Agent, or Firm* — Gerard E. Reinhardt

(57) ABSTRACT

A modular watercraft is disclosed which includes plural connectable modules and which can be broken down for ease of handling, transport and storage. The watercraft includes novel means for connecting separate modules. The connectable modules may be storable within a single one of the modules.

20 Claims, 27 Drawing Sheets

MODULAR WATERCRAFT

CROSS-REFERENCE TO RELATED APPLICATIONS

This application claims the benefit of U.S. Provisional Patent Application No. 61/791,712 filed Mar. 15, 2013 and U.S. Provisional Patent Application No. 61/927,769 filed Jan. 15, 2014, the entireties of which are incorporated herein by reference.

FIELD OF THE INVENTION

The invention relates to the field of watercrafts. More specifically, it relates to a modular watercraft.

BACKGROUND OF THE INVENTION

There are many types of small watercraft, sometimes referred to as personal watercraft. These are generally one- or two-person craft that may be unpowered, such as canoes, kayaks and the like, or powered, such as jet skis or a Mokai® jet-powered watercraft available from Mokai Manufacturing, Inc. of Newburgh, N.Y. Such watercraft can range from being fairly easy to handle and transport when out of the water to requiring significant effort.

SUMMARY OF THE INVENTION

The presently disclosed subject matter solves the aforementioned problem of handling and transporting watercraft when out of the water by providing and employing modular features.

In accordance with one embodiment a modular watercraft is provided which breaks down to multiple pieces for ease of handling, transport and storage. In accordance with another embodiment, a modular watercraft includes plural connectable modules. In accordance with a further embodiment a modular watercraft is disclosed which employs novel means for connecting separate modules. In accordance with yet a further embodiment a modular watercraft is disclosed wherein one or more modules thereof are "packable" or storable in other modules thereof.

In one embodiment, a modular watercraft hull is disclosed including a bow module having a bow at a first end and a bulkhead disposed on a second end opposite the bow, a cockpit module having a first end having a bulkhead and a second end opposite the cockpit module first end having a bulkhead, wherein the first end of the cockpit module is removably connectable to the second end of the bow module, and an engine compartment module having a first end having a bulkhead, wherein the engine compartment first end is removably connectable to the second end of the cockpit module. In one embodiment, the engine compartment module includes a second end opposite the first end, the engine compartment second end having a bulkhead.

In another embodiment, the bow module bulkhead includes at least one male element operable to engage a female element disposed on the first end bulkhead of the cockpit module. Optionally, the bow module bulkhead may include at least one female element operable to engage a male element disposed on the first end bulkhead of the cockpit module.

In still a further embodiment, the cockpit module second end bulkhead may include at least one male element operable to engage a female element disposed on the first end bulkhead of the engine compartment module. In still a further embodiment, the cockpit module second end bulkhead may include at least one female element operable to engage a male element disposed on the first end bulkhead of the engine compartment module.

The bow module bulkhead can include at least one latch assembly which may have at least one pin and a handle, wherein the pin is operable to engage at least one pin-receiving housing disposed on the first end of the cockpit module. The bow module bulkhead may also include at least one spool disposed thereon, wherein the at least one spool is operable to engage a channel disposed on the first end of the cockpit module.

In still a further embodiment, the cockpit module second end bulkhead may include at least one fastener having a bolt, wherein the bolt is operable to engage at least one bolt receiver disposed on the first end of the engine compartment module.

The cockpit module second end bulkhead may also include at least one guide pin, wherein the guide pin is operable to engage at least one pin receiver disposed on the first end of the engine compartment module.

It will be apparent that any bulkhead disclosed herein may include one or more guide pins and/or guide pin receivers, fasteners and/or bolt receivers, spools and/or spool channels, and latches and/or pin receivers as disclosed herein.

In a further embodiment, the engine compartment module may include an engine mounting system having rails disposed on an interior bottom surface of the engine compartment module, the rails oriented in substantial axial alignment with a long axis of the engine compartment module, at least one bracket extending from the rails and oriented perpendicular to and spanning the rails, the at least one bracket operable to receive connecting means engaged to an engine. The engine mounting system may further include at least one further bracket extending from at least one of the rails in a direction toward the second end of the engine compartment module, the at least one further bracket operable to be attached to the engine compartment module bulkhead. The engine mounting system may further have at least one bracket operable to be fixed to an engine to be mounted, the bracket having at least two pins oriented and spaced from each other to be aligned with apertures formed in the at least one bracket extending from the rails.

In one embodiment, the cockpit module is sized and configured to contain the bow module and the engine compartment module.

In another embodiment, a system is provided including a modular watercraft as described above and an engine, wherein the engine is removably mountable in the engine compartment module.

Novel fasteners and latch devices are also disclosed.

Embodiments of modular watercraft are disclosed in the accompanying drawings and description. Given above is a simplified summary in order to provide a basic understanding of some aspects described herein. This summary is not an extensive overview, and is not intended to identify key/critical elements or to delineate the scope of the claimed subject matter.

BRIEF DESCRIPTION OF THE DRAWINGS

So that those having ordinary skill in the art will have a better understanding of how to make and use the disclosed systems and methods, reference is made to the accompanying figure wherein.

DETAILED DESCRIPTION OF THE INVENTION

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Figure 1:
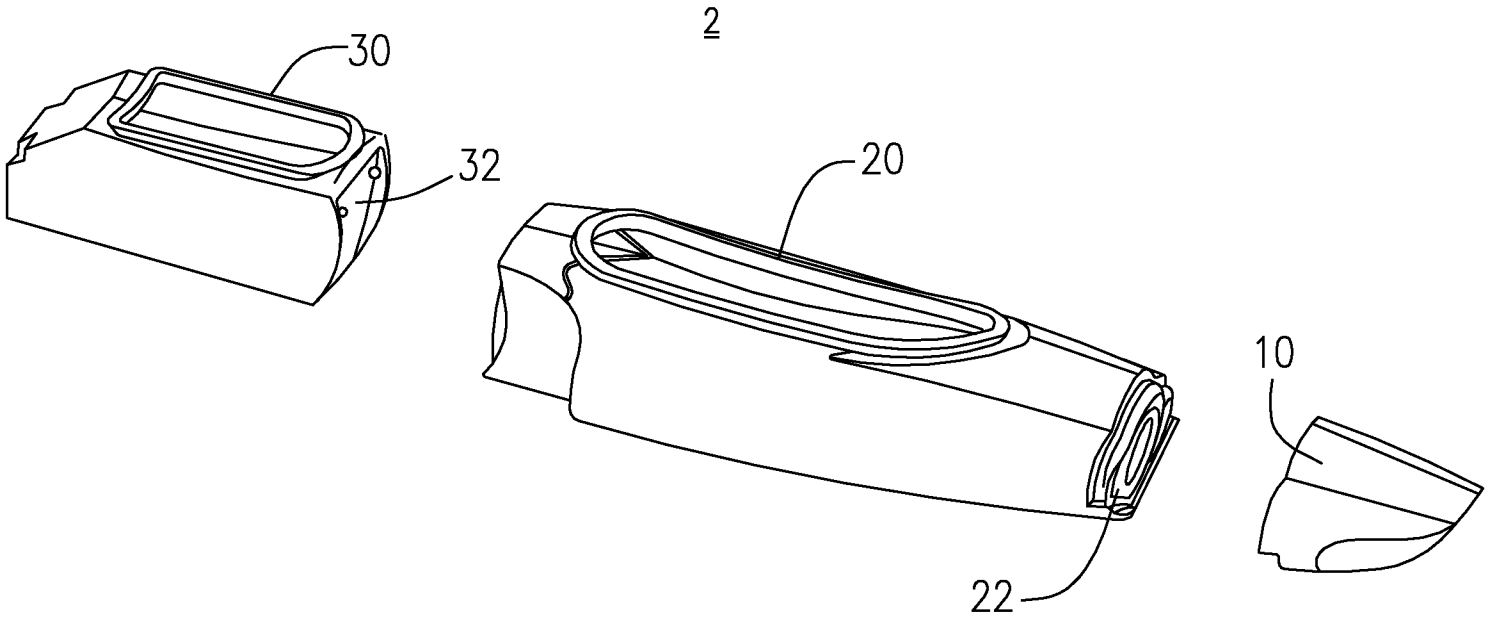
FIG. 1 is a perspective view of a modular watercraft in accordance with an embodiment of the disclosed subject matter.
Figure 1A:
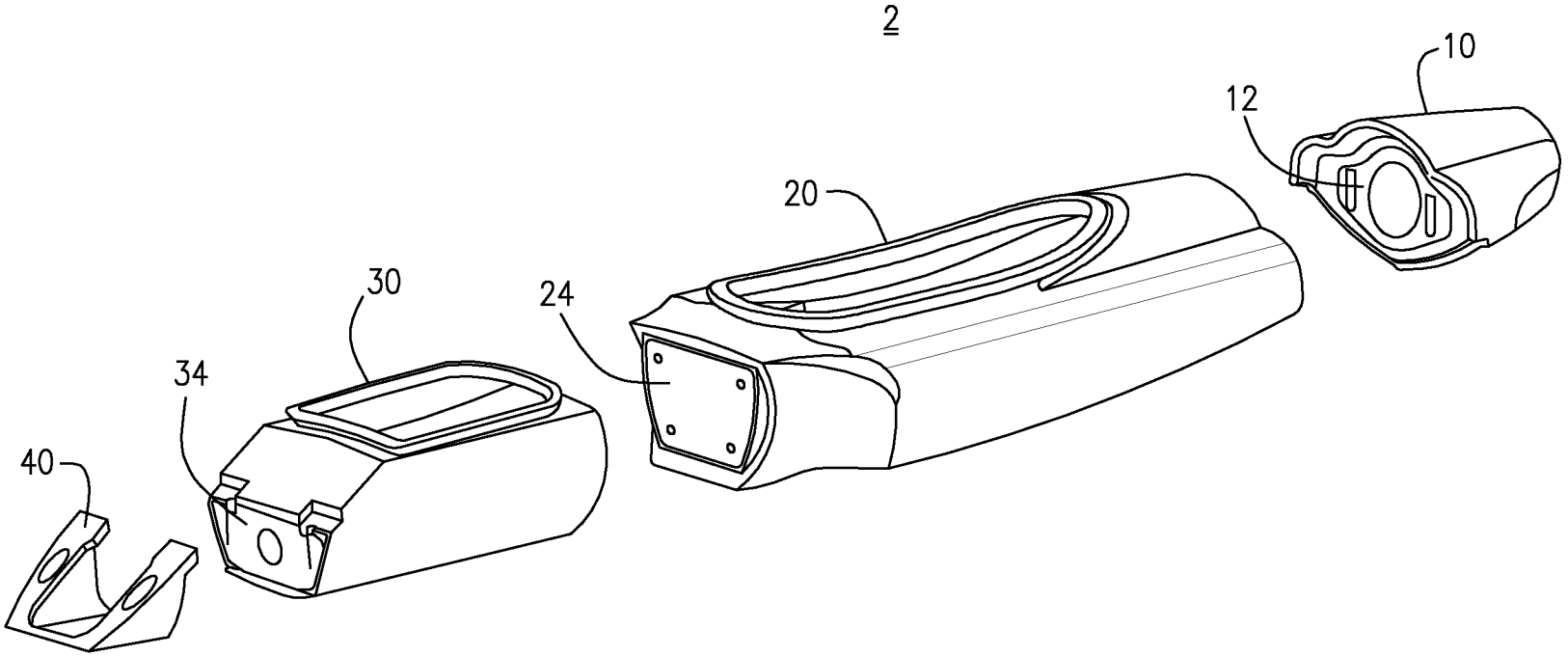
FIG. 1A is a perspective view of an embodiment of the modular watercraft in accordance with FIG. 1.

Now referring to FIGS. 1 and 1A, a watercraft 2 includes a bow module 10, a cockpit module 20 and an engine compartment module 30. Modules 10, 20 and 30 are connectable to form a complete watercraft 2. With further reference to FIG. 1A, each of the modules 10, 20 and 20 may include at least one bulkhead to provide a secure fit between adjacent modules. Cockpit module 20 may include bulkheads 22 and 24. Bow module 10 may include bulkhead 12, which in one embodiment is connectable to bulkhead 22 of cockpit module 20. Similarly, bulkhead 24 of cockpit module 20 is connectable to bulkhead 32 of engine compartment module 30. In the embodiment shown in FIG. 1A, engine compartment module 30 may further include a bulkhead 34, for connection to an optional stern module 40.

Figure 2:
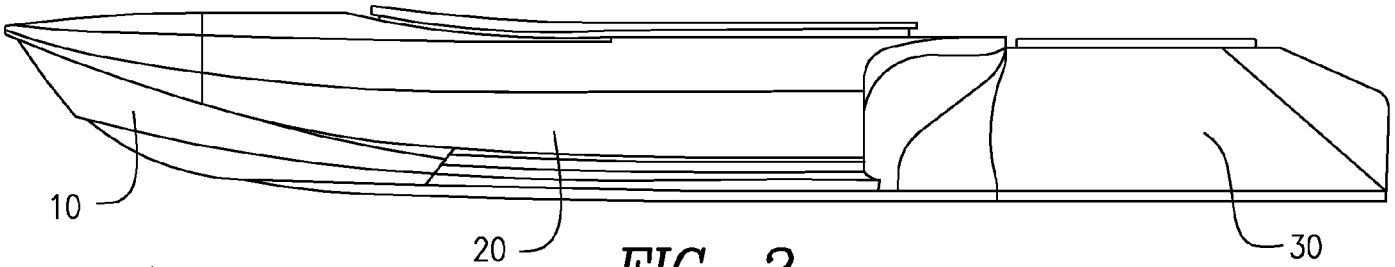
FIG. 2 is a side view of a modular watercraft in accordance with an embodiment of the disclosed subject matter.
Figure 2A:
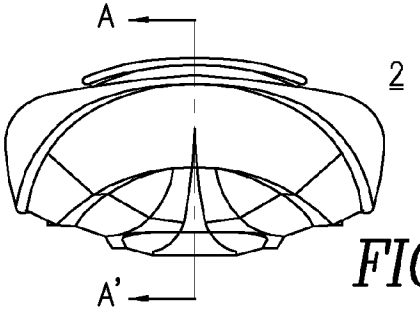
FIG. 2A is a front view of a modular watercraft in accordance with an embodiment of the disclosed subject matter.
Figure 2B:
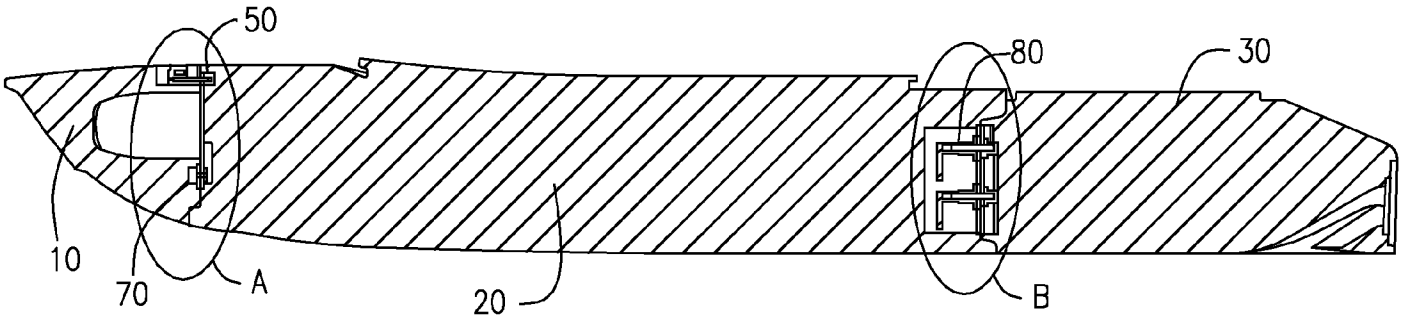
FIG. 2B is a side cross-sectional view of a modular watercraft taken along line A-A' of FIG. 2A.

Now referring to FIGS. 2-2B, modules 10, 20 and 30 are connectable to form a complete watercraft. Those skilled in the art will recognize the shapes, contours, etc. of the modules are not limited to those shown in the drawings, which are merely exemplary. The modules may take any form as long as when connected, a watercraft is formed.

The bow module 10 has a longest length measured from the front end of the bow module to the rear end (i.e., the end which is connectable to the cockpit module 20) in the range of 6 to 36 inches, preferably from 10 to 30 inches and more preferably from 18 to 22 inches. The bow module 10 has a widest width in the range of 12 to 72 inches, preferably from 20 to 60 inches and more preferably from 28 to 50 inches. The bow module 10 has a highest height measured from the top of the hull to the bottom of the hull in the range of 6 to 36 inches, preferably from 10 to 20 inches and more preferably from 12 to 18 inches. In one embodiment the bow module 10 has a longest length of 19 inches, a widest width of 32 inches, and a highest height of 15.25 inches. The bow module may have a volume of about 432 $in^3$ to about 93,312 $in^3$.

The cockpit module 20 has a longest length measured from the front end (i.e., the end connectable to the bow module 10) of the cockpit module 20 to the rear end (i.e., the end connectable to the engine compartment module 30) in the range of 36 to 336 inches, preferably from 40 to 200 inches and more preferably from 60 to 90 inches. The cockpit module 20 has a widest width in the range of 12 to 72 inches, preferably 20 to 60 inches, and more preferably 30 to 45 inches. The cockpit module 20 has a highest height measured from the top of the hull to the bottom of the hull in the range of 6 to 36 inches, preferably from 10 to 30 inches and more preferably from 15 to 25 inches. In one embodiment the cockpit module 20 has a longest length of 77.5 inches, a widest width of 36 inches and a highest height of 19 inches. The cockpit module may have a volume of about 2,592 $in^3$ to about 435,456 $in^3$.

The engine compartment module 30 has a longest length measured from the front end (i.e., the end connectable to the cockpit module 20) of the engine compartment module 30 to the rear end in the range of 12 to 72 inches, preferably 25 to 60 inches and more preferably 30 to 50 inches. The engine compartment module has a widest width in the range of 6 to 72 inches, preferably 10 to 60 inches, and more preferably 15 to 40 inches. The engine compartment module 30 has a highest height measured from the top of the hull to the bottom of the hull in the range of 6 to 36 inches, preferably from 10 to 30 inches and more preferably from 15 to 25 inches. In one embodiment the engine compartment module 30 has a longest length of 39 inches, a widest width of 19.25 inches and a highest height of 15.25 inches. The engine compartment module may have a volume of about 432 $in^3$ to about 186,624 $in^3$.

The modules 10, 20, 30 and optionally 40 may be formed of any suitable material recognized in the art to provide a seaworthy component. For examples, the modules may be aluminum, fiberglass, plastic or the like. In one embodiment the modules are thermoformed or rotomolded plastic to provide a lightweight component. The faces of adjoining modules, and/or bulkheads, may include complementary male and female profiles for added strength and stability and provide for a smooth surface transition from bow to stern when assembled. For example, a given bulkhead may include both pins and apertures, and an adjoining bulkhead may include complementary, corresponding apertures and pins, respectively. It may be desirable to employ pins which help position and guide each module as adjoining modules are coupled. Adjoining modules may include complementary molded or thermoformed lips or ridges for added stability and ease of fit.

Bulkheads may be formed of any rigid, durable material such as metal, polymer, ceramic or other suitable material. Bulkheads may be mounted directly to each module via inserts molded into the module. For example, each module may be thermoformed, rotomolded or the like to include male or female parts complementary to a corresponding female or male part of a bulkhead. In another embodiment, bulkheads may be fixed to modules by adhesive, or mechanical means such as screws, bolts or the like. It will be apparent to those having skill in the art that more than three modules may be employed.

In one or more embodiments, any of modules 10, 20 and/or 30 may include at least one sealed cavity to provide buoyancy. In one embodiment, the bow module 10 may be air- and water-tight, to form a sealed interior cavity. In this embodiment the bow module 10 provides a flotation device.

In one embodiment mating aluminum bulkheads, such as mating bulkhead pair 24, 32 and pair 12 and 22, are substantially identical in profile to support proper load displacement.

In hulls made of roto-molded plastic or the like such as those which may be used in connection with watercraft disclosed herein, previous products have used a solely plastic to plastic interface when assembling, in which the mating faces are never exactly the same due to material shrinkage, wear, plastic drift, material instability, fabrication defects, etc. Employing precision-machined components, and the use of bulkheads of a stable material such as aluminum, enables a much stronger, more accurate, and reliable connection every time it is made. These bulkheads also provide the ability to transfer any loads over a much larger area reducing the amount of stress at any one point.

Connections between adjacent modules and bulkheads may be achieved using bolts, screws or other removable fastening devices. For ease of assembly and disassembly, it may be preferred to employ other fasteners and/or latching devices.

With reference to FIG. 2B, in one embodiment, adjoining modules 10, 20 and 20, 30 may be removably connected using one or more latching devices 50, such as cam-locking levers or the like, to removably lock adjacent modules together. The locking device(s) 50 provide resistance to separation during storage, transportation and/or use. The adjoining modules may also include a spool/channel arrangement 70 and or/fasteners 80 to removably lock adjoining modules together.

Figure 3B:
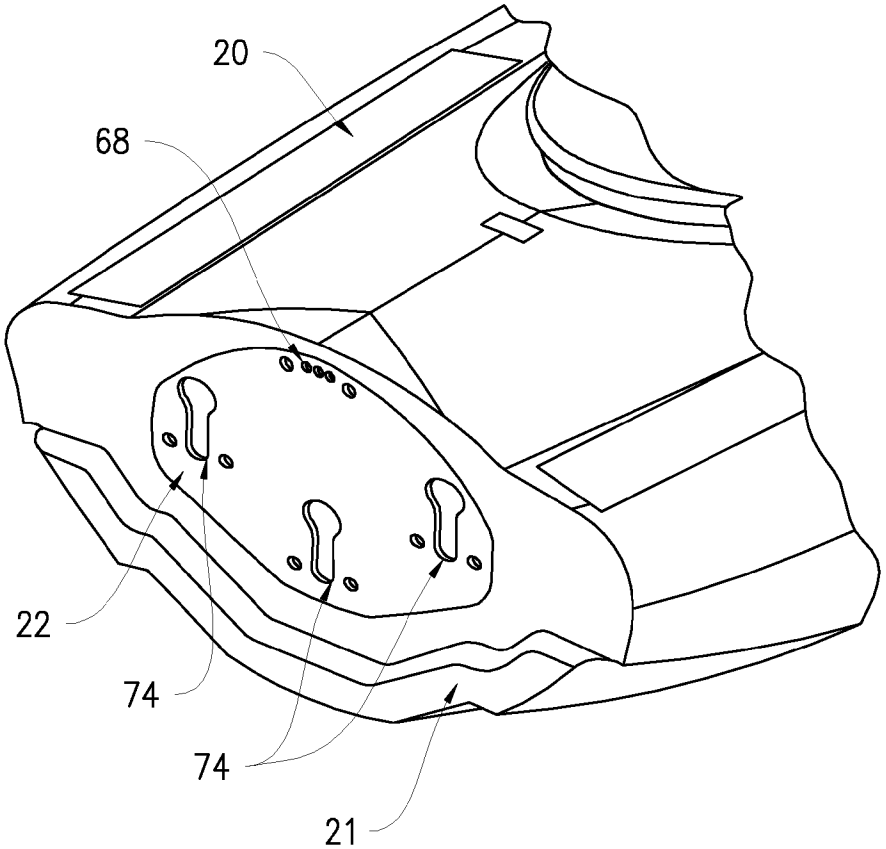
FIG. 3B is an elevated perspective view of a front end of a cockpit module and bulkhead in accordance with an embodiment of the disclosed subject matter.
Figure 3A:
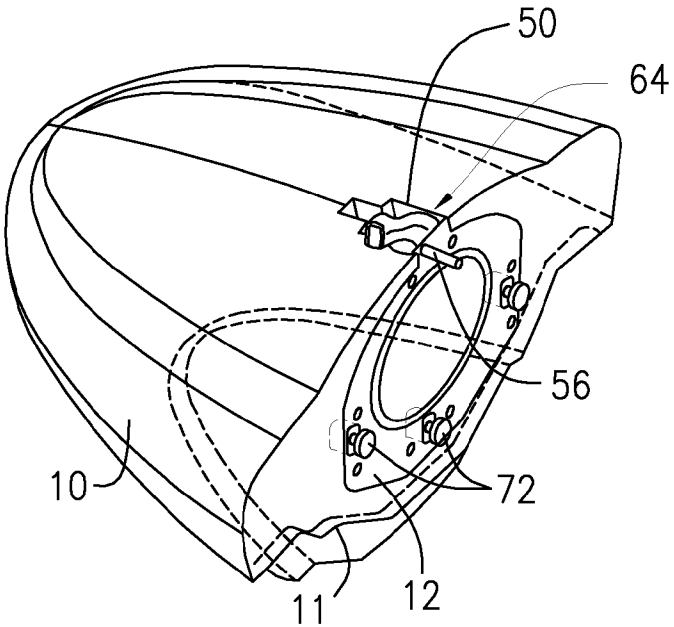
FIG. 3A is an elevated perspective view of a bow module and bulkhead in accordance with an embodiment of the disclosed subject matter.
Figure 3D:
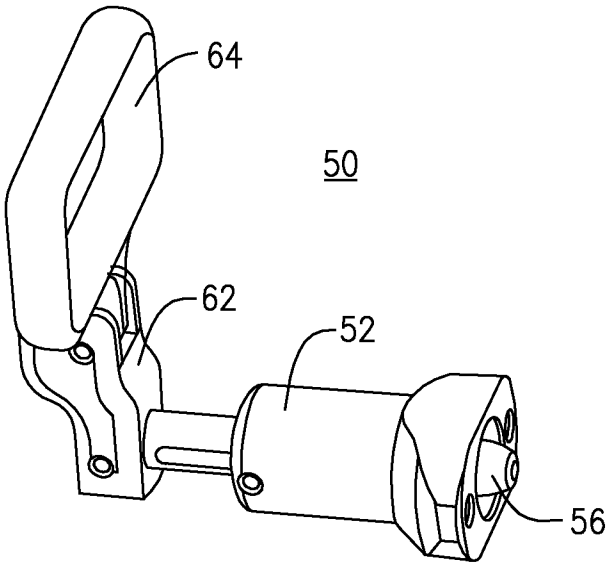
FIG. 3D is an elevated perspective view of a locking pin assembly having a handle and a pin in a first position in accordance with an embodiment of the disclosed subject matter.
Figure 3C:
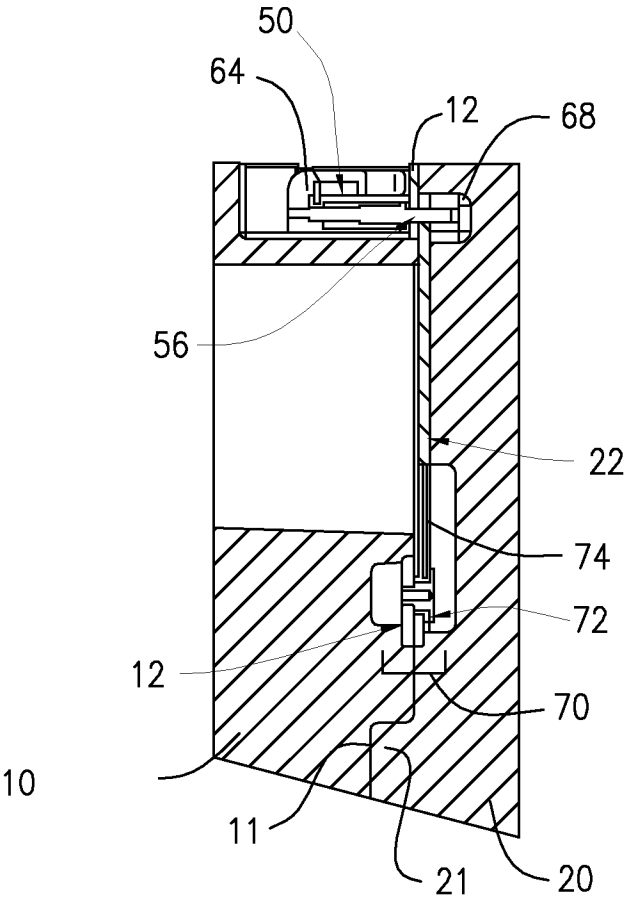
FIG. 3C is an enlarged view of detail A of FIG. 2B with reference to FIGS. 3A and 3B, depicting apparatus for connecting adjacent modules in accordance with an embodiment of the disclosed subject matter.
Figure 3E:
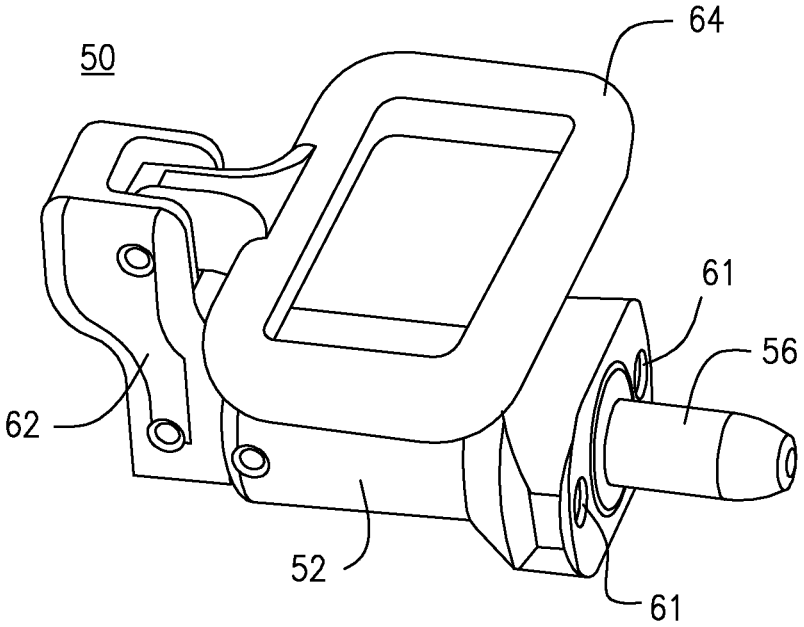
FIG. 3E is an elevated perspective view of the locking pin assembly of FIG. 3D wherein the handle and pin are in a second position in accordance with an embodiment of the disclosed subject matter.
Figure 3F:
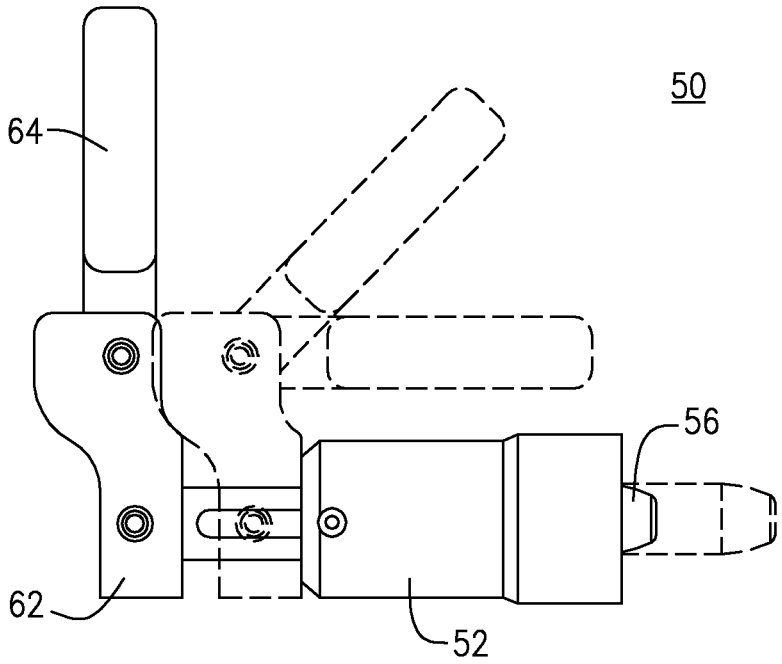
FIG. 3F is a side view of the locking pin assembly of FIG. 3D depicting the relative positions (some shown in phantom) of the components of the locking pin assembly depending on movement of the handle in accordance with an embodiment of the disclosed subject matter.
Figure 3G:
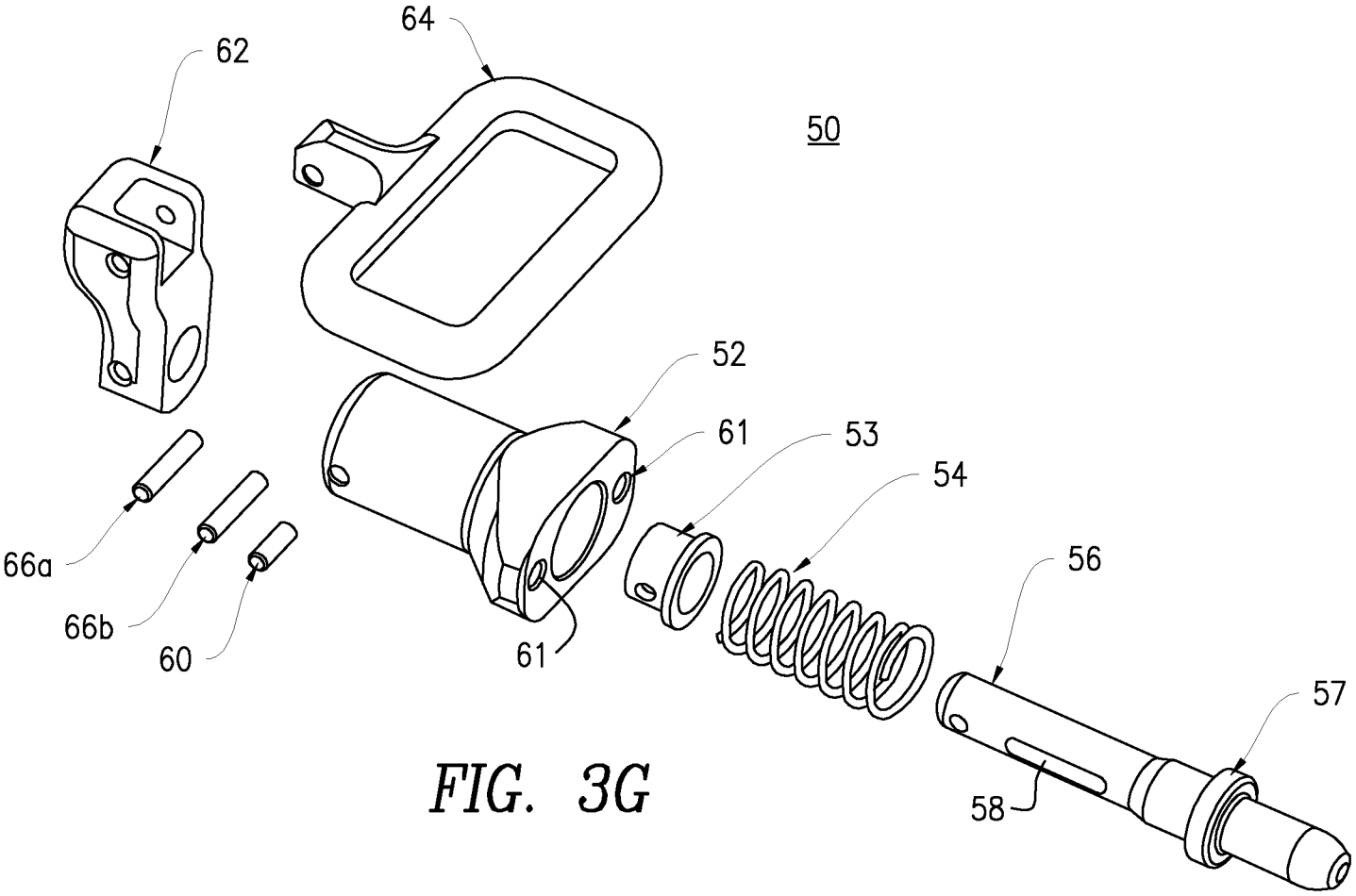
FIG. 3G is an exploded view of the locking pin assembly of FIG. 3D in accordance with an embodiment of the disclosed subject matter.

Now referring to FIGS. 3A-3C, in one or more embodiments examples of a latch assembly and spool/channel assembly are provided. In FIG. 3A bow module 10 includes molded lip 11, bulkhead 12, a latch assembly 50 mounted on a top portion of the bow module 10, such as by bolts, screws or the like fastened to the bulkhead 12, and spools 72. In FIG. 3B, cockpit module 20 includes molded lip 21, bulkhead 22, spool guide channels 74 and a pin-receiving housing 68. With further reference to FIG. 3C, when bow module 10 and cockpit module 20 are adjoining, spools 72 are seated in guide channels 74. Complementary molded lips 11 and 21 are seated in close contact. Pin 56 is receivable in pin-receiving housing 68.

With further reference to FIGS. 3D-3G, in one embodiment the latch assembly 50 includes pin housing 52, guide bushing 53, spring 54, locking pin 56, guide pin 60, handle base 62, handle 64 and hinge pins 66*a*, 66*b*. Latch assembly includes openings 61 which may include threads for receiving a threaded fastener, such as a bolt, screw or the like, for facilitating fastening of the latch assembly 50 to a bulkhead (for example as shown in FIG. 3C).

The handle base 62 is attached to the end of the locking pin 56 with hinge pin 66*a*. The handle base 62 may be machined with a press fit for hinge pin 66*a*, securing it in place and preventing backing out of the pin 66*a*. Handle 64 is hingedly attached to handle base 62 with hinge pin 66*b*.

Handle 64 is movable to advance and retract spring-loaded locking pin 56 to engage the pin receiving housing 68. The locking pin may be tapered for ease of fit and engagement with the pin receiving housing 68. Movement of the handle 64 toward the pin housing 52 causes the spring loaded locking pin 56 to engage the receiving housing 68 positioned on the cockpit front bulkhead 22, locking the bow module 10 into position with the cockpit module 20. The spring 54 maintains a biasing force against the locking pin flange 57 preventing the locking pin 56 from retracting from the receiving housing 68. Movement of the handle away from the pin housing 52 causes the locking pin to retract from the receiving housing 68, allowing the bow module 10 and cockpit module 20 to be unlocked, enabling disconnection of the modules 10 and 20 by disengagement of the spools 72 from the spool guide channels 74. The fully engaged and retracted positions of the locking pin 56 may be a predetermined distance controlled by the installation of the guide pin 60 into the pin housing 52 by for example press fit, with one end of the guide pin 60 set in a clearance slot 58 on the side of the locking pin 56. Positioning the guide pin 60 within the clearance slot 58 also prevents the locking pin 56 from rotating. Guide bushing 53 located in pin housing 52 is operable to permit locking pin 56 to move in a linear motion when force is applied to the handle 64.

The latch assembly 50 is tamper resistant, in that once assembled it cannot be disassembled due to the blind openings in which the hinge pins are installed. As a safety feature, the latch assembly 50 may be designed so that the default (free standing) position of the locking pin 56 is in the engaged position, thereby reducing the possibility of mechanical failure during use, and premature separation of the connection between adjoining modules, for example, the connection between the bow module 10 and cockpit module 20.

Figure 4A:
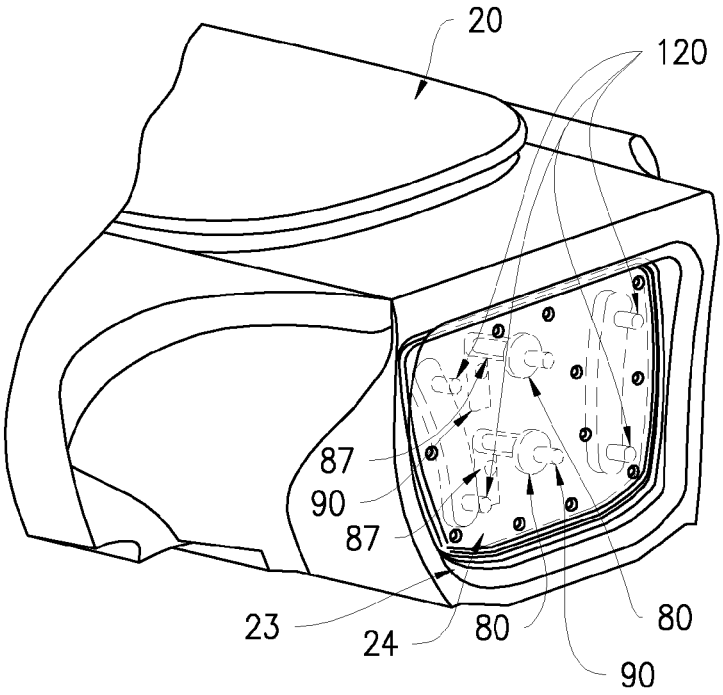
FIG. 4A is an elevated perspective view of a rear end of a cockpit module and bulkhead in accordance with an embodiment of the disclosed subject matter.
Figure 4B:
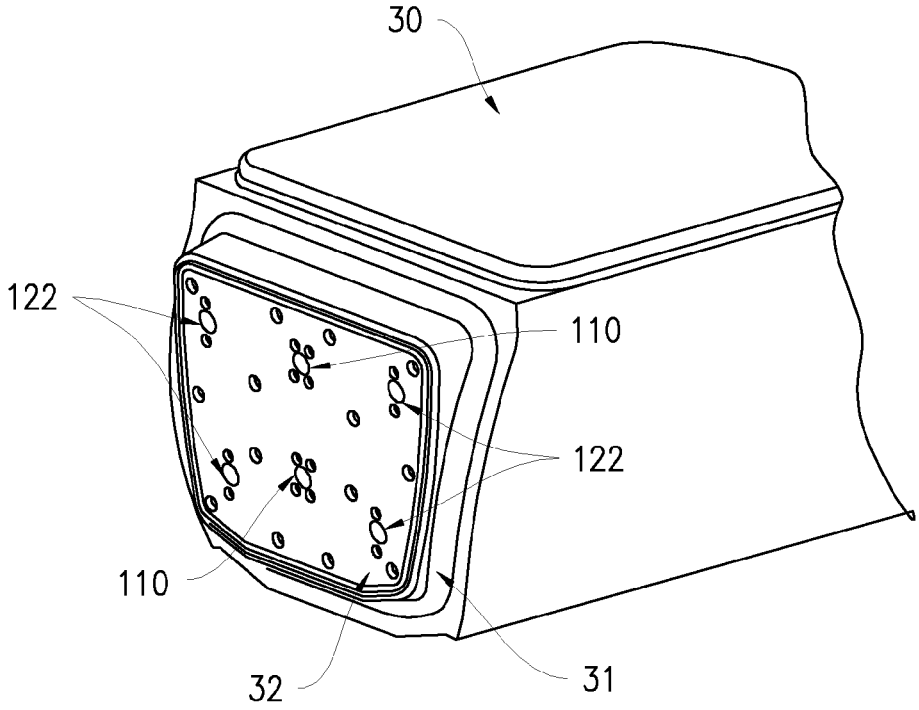
FIG. 4B is an elevated perspective view of an engine compartment module and bulkhead in accordance with an embodiment of the disclosed subject matter.
Figure 4C:
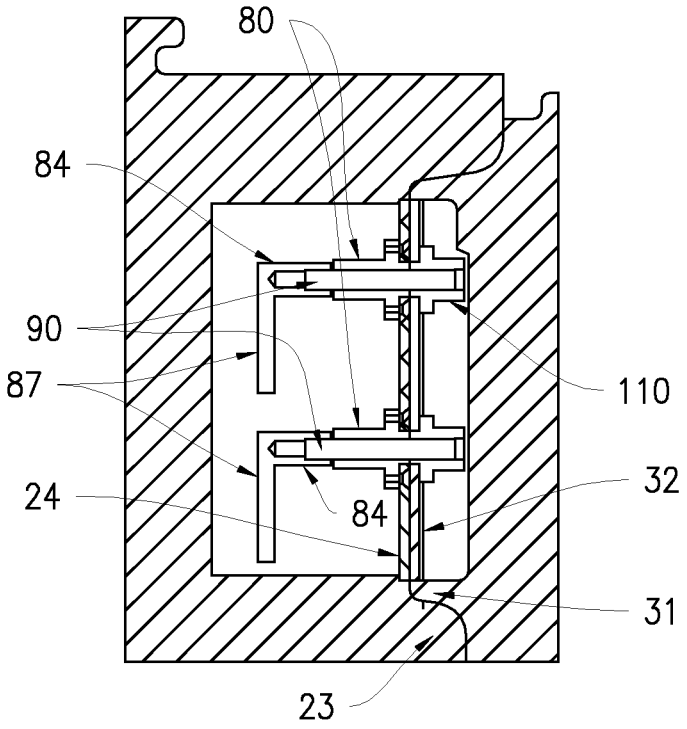
FIG. 4C is an enlarged view of detail B of FIG. 2B with reference to FIGS. 4A and 4B, depicting apparatus for connecting adjacent modules in accordance with an embodiment of the disclosed subject matter.

Now referring to FIGS. 4A-4C, in one embodiment an engine compartment module 30 module may be removably engaged to a cockpit module 20. While various means may be employed to removably engage the modules 20 and 30, such as the latch assembly 50 and/or spool/channel arrangements discussed hereinabove, in another embodiment the cockpit module 20 and engine compartment module 30 may employ a fastener 80 which provides high structural integrity and water-tight attributes.

With reference to FIG. 4A, cockpit module 20 includes molded lip 23, cockpit bulkhead 24, guide pins 120, and fastener 80. With reference to FIG. 4B, engine compartment module 30 includes molded edge 31, engine compartment bulkhead 32, pin receivers 122 and fastener bolt receivers 110. Now referring to FIG. 4C, when the modules 20, 30 are brought together so that bulkheads 24 and 32 are adjacent, the cockpit module lip 23, which forms a generally female profile, and the engine compartment molded edge 31, which forms a generally male profile, seat snugly forming a tight joint profile. Simultaneously, guide pins 120 are received in pin receivers 122, and fasteners 80 are aligned with fastener bolt receivers 110.

Figure 4D:
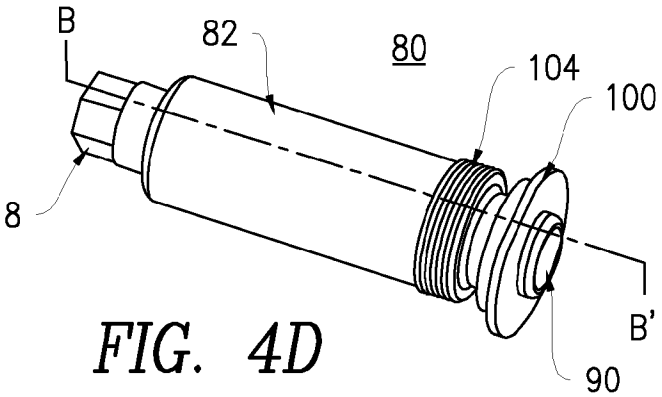
FIG. 4D is a side perspective view of a fastener in accordance with an embodiment of the disclosed subject matter.
Figure 4E:
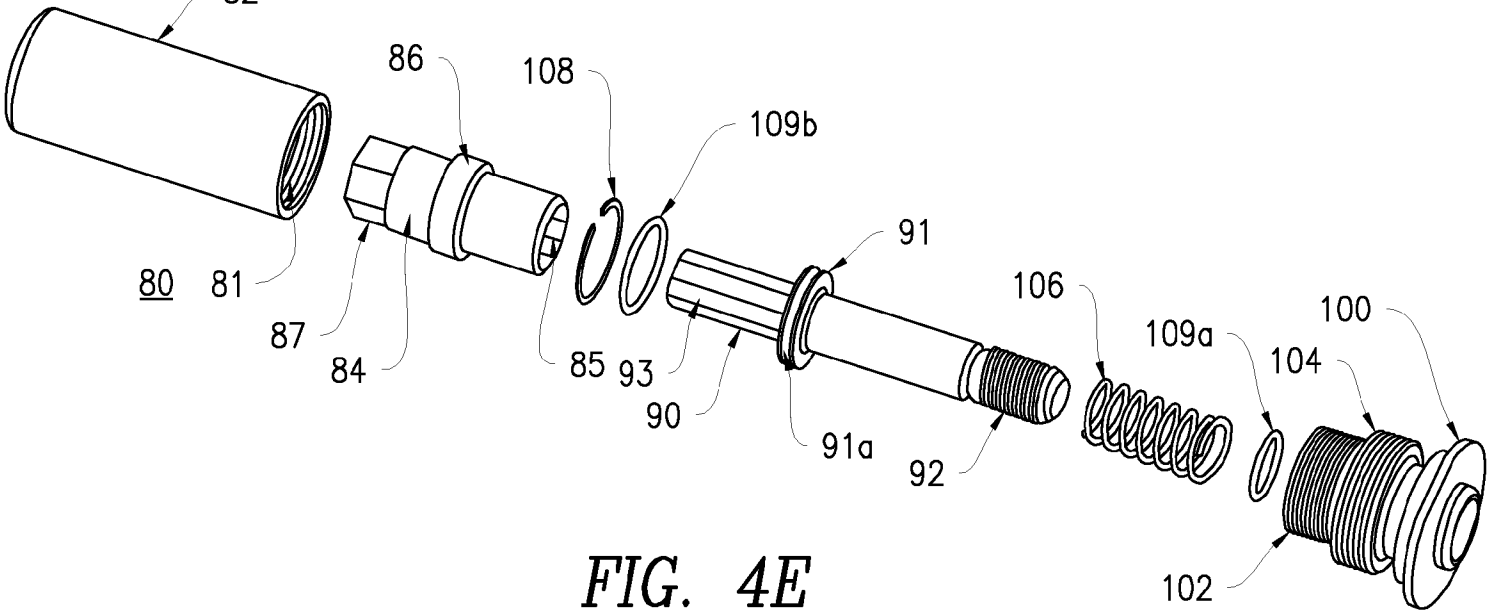
FIG. 4E is an exploded view of the fastener of FIG. 4D in accordance with an embodiment of the disclosed subject matter.

Once the respective modules 20, 30 are brought into abutment so that the lip 23 and molded edge 31 are seated, for example as shown in FIG. 4C, fasteners 80 in conjunction with fastener bolt receivers 110 are employed to pull the modules 20, 30 together and prevent them from separation during use. Now referring to FIGS. 4D and 4E, in accordance with one embodiment, a fastener 80 includes a fastener barrel 82, fastener lug 84, fastener bolt 90 and fastener bolt housing 100. Fastener 80 is securable to a bulkhead such as bulkhead 24 such as by a threadable engagement of threaded section 104 of fastener bolt housing 100 with a complementary nut having an interior threaded bore. The wall of the module 20 adjacent bulkhead 24 may form a gasket to provide a watertight seal. Further gaskets may be employed for forming a water tight seal. In another embodiment the fastener 80 is securable to a bulkhead such as bulkhead 24 such as by a threadable engagement of threaded section 104 of fastener bolt housing 100 with a threaded bore formed in a bulkhead. In another embodiment the threaded bore may be a nut fixed Fastener lug 84 includes a tool end 87 for applying rotational force to the fastener lug 84. Tool end 87 may include a handle as shown in FIGS. 4A and 4C, or may include a head operable to receive and engage a tool. In one embodiment the tool end 87 is a head having a hexagonal cross-section operable to receive a tool such as a wrench, pliers or the like. Those skilled in the art will recognize tool end 87 may include a head operable to receive a screwdriver head or the like.

Figure 4F:
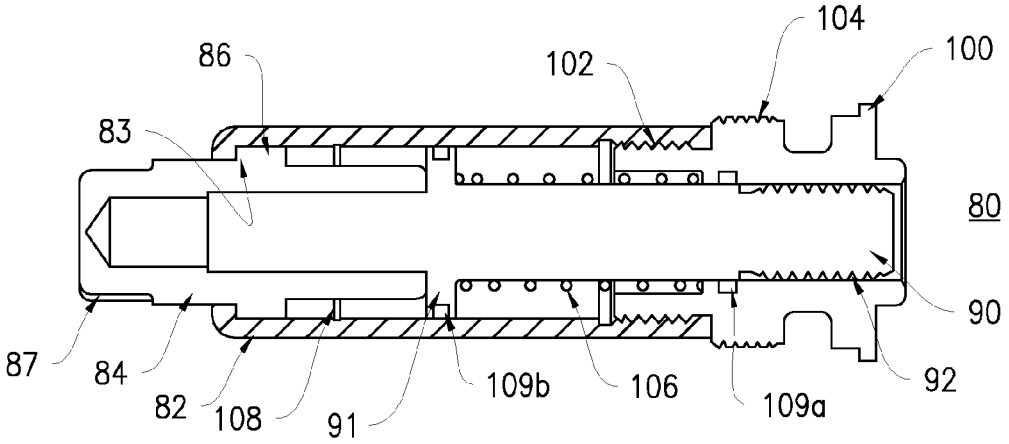
FIG. 4F is a side cross-sectional view of the fastener of FIG. 4D taken along line B-B' in accordance with an embodiment of the disclosed subject matter.
Figure 4G:
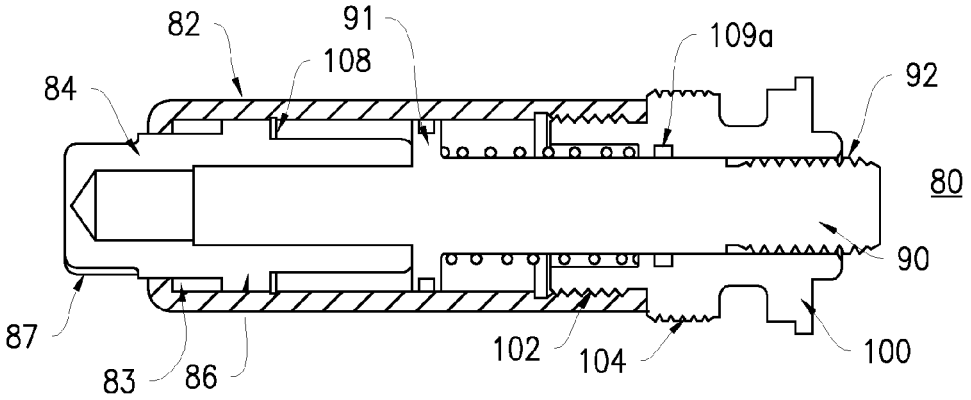
FIG. 4G is a view of the fastener of FIG. 4F wherein a bolt contained therein is positioned in a first position in accordance with an embodiment of the disclosed subject matter.
Figure 4H:
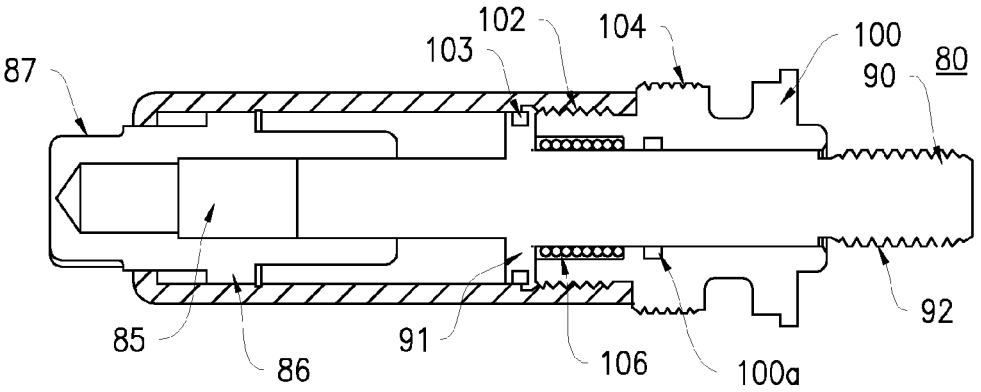
FIG. 4H is a view of the fastener of FIG. 4F wherein a bolt contained therein is positioned in a second position in accordance with an embodiment of the disclosed subject matter.

With reference to FIG. 4F, a spring 106 keeps the fastener bolt 90 in a retracted position while the module to which it is mounted (for example, module 20 at bulkhead 24 in FIGS. 4A, 4C) is not engaged to another module, keeping the threads 92 of fastener bolt 90 free from damage and/or debris. Now referring to FIG. 4G, fastener lug 84 may be advanced against the biasing force of spring 106, such as by pressure applied by an operator (either by manual pressure or with the assistance of a suitable tool), moving the fastener bolt 90 from a fully retracted position to a predetermined engagement position, which may be set using for example a retaining clip 108, against which a lug flange 86 will contact and stop. The predetermined engagement position preferably brings the threads 92 of fastener bolt 90 into close, threadable connection with the fastener bolt receiver 100. "Close, threadable connection" as used herein means at least one thread of threads 92 is positioned relative to the fastener bolt receiver 110 such that rotational force applied to the fastener bolt will commence a threaded connection between the fastener bolt 90 and the fastener bolt receiver 110.

The fastener lug 84 includes a bore 85 within which a contoured end 93 of the fastener bolt 90 is slidably engaged along the long axis of the bore 85. As rotational force is applied to the fastener lug 84, the threaded end 92 of fastener bolt 90 is turned in, and threadably engages, fastener bolt receiver 110 disposed on the engine compartment bulkhead 32. The contoured end 93 of the fastener bolt 90, while slidably engaged in the bore 85, is specifically keyed to the interior surface of the bore 85, allowing rotation of the fastener lug 84 to be transferred to the fastening bolt 90. For example, the contoured end 93 may have a cross-section which is hexagonal which corresponds to a hexagonal-cross section of the bore 85. The skilled artisan will recognize the cross-sections of the corresponding end 93 and bore 85 may be any suitable shape. As the fastener bolt 90 is threaded and advanced into the fastener bolt receiver 110, flange 91 bottoms out against the face 103 of the fastener bolt housing 100, securing the adjacent modules 20 and 30 together. At this point the spring 106 is in a compressed state, keeping a positive pressure against the threads 92 by frictional force, preventing ease of backing out/loosening during use.

In one embodiment, one or more seals, such as O-rings may be employed to prevent leaking of water into modules employing the fastener 80. For example, for a fastener 80 mounted to the cockpit module 20 at bulkhead 24, a first seal 109*a* is positioned within an annular groove 100*a* formed in the fastener bolt housing 100 and seals against the outer diameter of the fastener bolt 90. A seal 109*b* is positioned in an annular recess 91*a* formed along the periphery of flange 91 of the fastener bolt 90, forming a seal against an inner circumference of fastener barrel 82.

It will be apparent to the skilled artisan that the latches, fasteners and spool/channel securement means disclosed herein may be used in various combinations as between the bow, cockpit and engine compartment modules. For example, it may be desirable to use at least one latch assembly 50 in combination with at least one fastener assembly 80 for connecting engine compartment module 30 with cockpit module 20. It may be desirable to further employ a spool/channel arrangement 70 for such connection. Alternatively, it may be desirable to employ at least one fastener assembly 80 for connecting cockpit module 20 with bow module 10, in addition to at least one latch assembly 50 and/or as a substitute for at least one spool channel arrangement. Moreover, it will be apparent that one or more guide pins/receivers may be used as desired for purposes of facilitating connections between bulkheads of modules to be connected.

It will also be apparent to those skilled in the art that the placement of connection, fastening, latching and/or alignment devices may be in any suitable location. For example, it may be desirable to fix at least one fastener 80 on bulkhead 32 and position at least one complementary fastener bolt receiver 110 on bulkhead 24. Similarly, alignment devices including guide pins 120 may be positioned on bulkhead 22, and guide pin receivers 122 positioned on bulkhead 32.

One skilled in the art will recognize alternative, and/or additional devices, may include but not be limited to a cam-lock device, dead-bolt type of lock or the like.

The modules may be disassembled for transportation and/or storage. In one embodiment, modules 10 and 30 are storable in cockpit module 20, reducing the amount of room and/or vehicle space required to house the watercraft 2.

Figure 5:
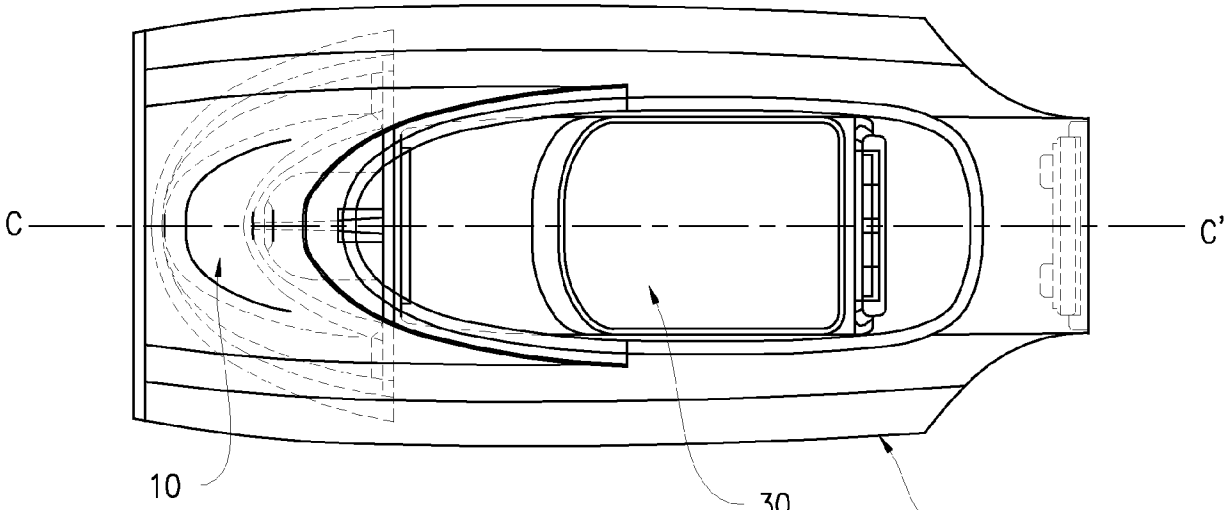
FIG. 5 is a top plan view of a cockpit module wherein bow (in phantom) and stern modules are fitted in the cockpit module in accordance with one embodiment of the disclosed subject matter.
Figure 5A:
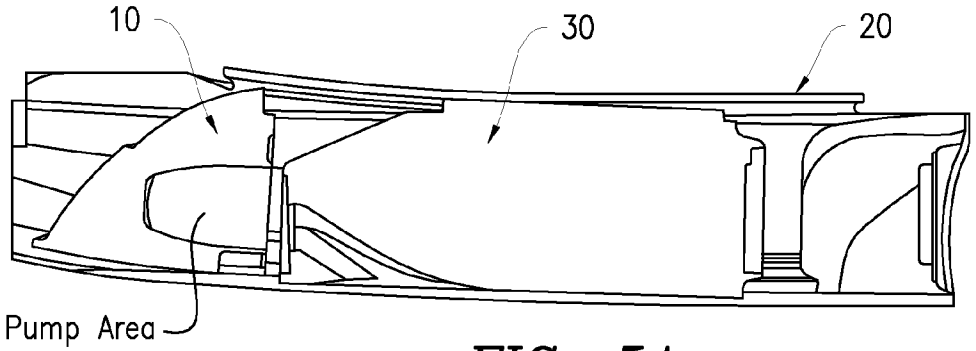
FIG. 5A is a side cross-sectional view of the cockpit module containing bow and stern modules in accordance with FIG. 5 taken along line C-C'.

Now referring to FIGS. 5A-5B, in accordance with another aspect, bow module 10 and engine compartment module 30 of the watercraft may be stored within the cockpit module 20. The interior of the cockpit module 20 is configured to receive and contain the bow module 10 as shown. In one embodiment the bow module 10 may be positioned and securely fitted in a forward portion of the cockpit module 20 and upside down, which enables the watercraft pump and waterjet nozzle extending from the engine compartment module 30 to be placed into a section of the cockpit module 10 configured to accommodate it. The design/configuration permits easy transportation, storage, shipping, and ultimately easier/friendlier operator use.

When the modules 10, 20 and 30 are assembled, the watercraft may be employed in conjunction with a power and drive system as used for example in connection with a Mokai® jet-powered watercraft available from Mokai Manufacturing, Inc. of Newburgh, N.Y. Certain other embodiments are described herein.

Figure 6:
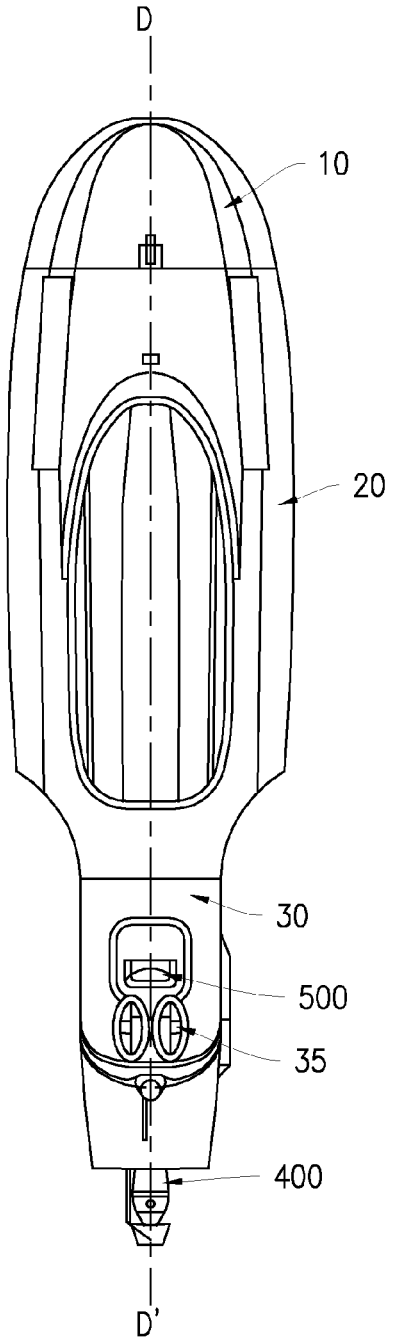
FIG. 6 is a top plan view of a watercraft in accordance with an embodiment of the disclosed subject matter.
Figure 6A:
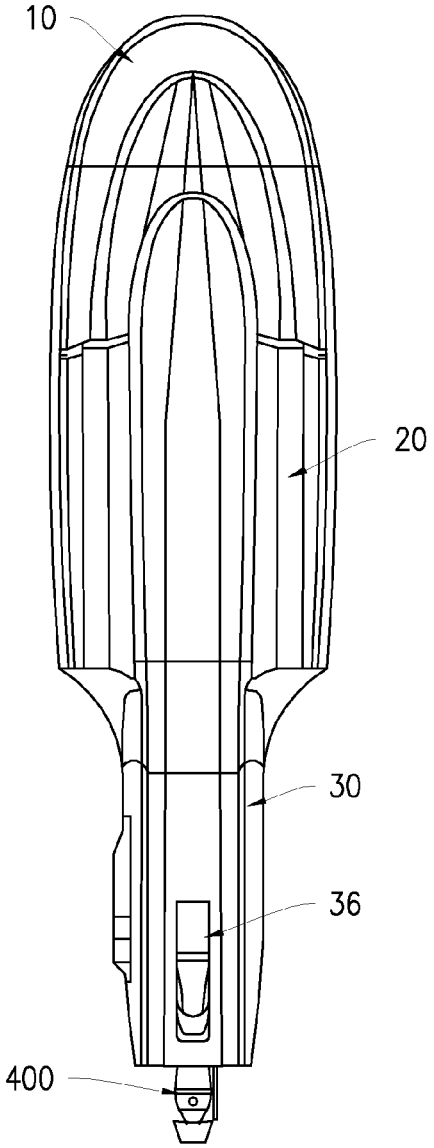
FIG. 6A is a bottom plan view of a watercraft in accordance with an embodiment of the disclosed subject matter.
Figure 6B:
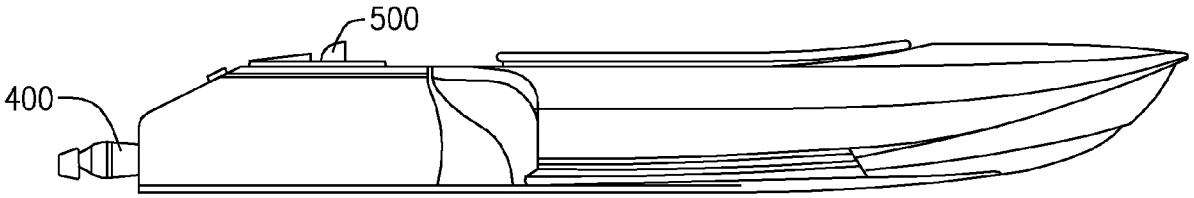
FIG. 6B is a side view a watercraft in accordance with an embodiment of the disclosed subject matter.
Figure 6C:
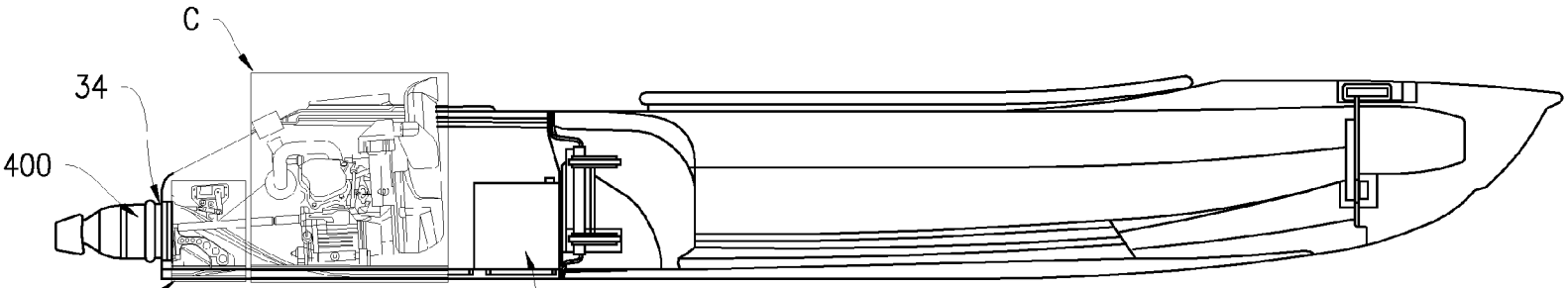
FIG. 6C is a side cross-sectional view of the watercraft of FIG. 6 taken along line D-D'.
Figure 6D:
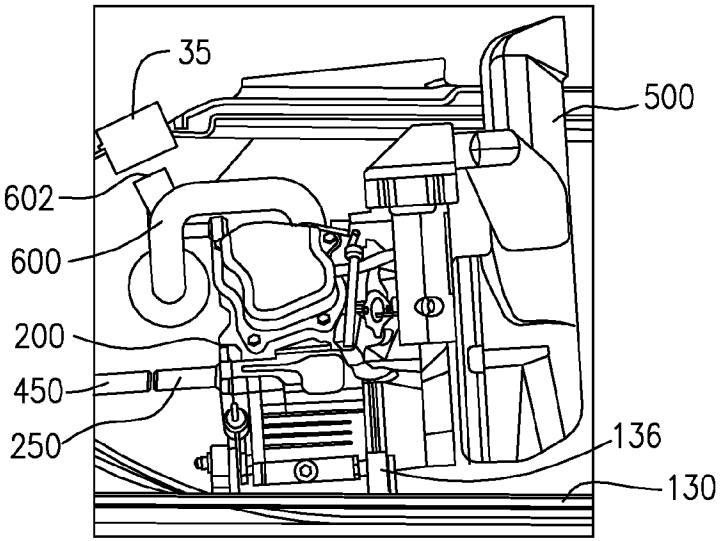
FIG. 6D is an enlarged view of detail C of FIG. 6C including intake, drive, exhaust, and motor mounting elements of a watercraft in accordance with an embodiment of the disclosed subject matter.
Figure 6E:
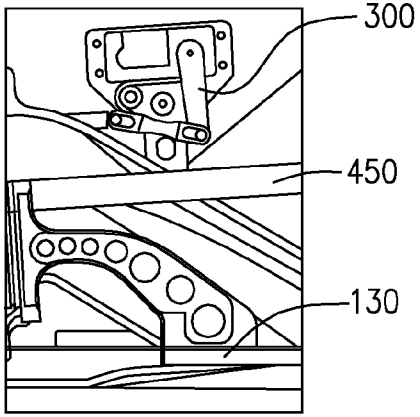
FIG. 6E is an enlarged view of detail D of FIG. 6C including drive and steering elements of a watercraft in accordance with an embodiment of the disclosed subject matter.

With reference to FIGS. 6-6D in one embodiment a watercraft including modules 10, 20 and 30 further includes ports 35 formed in engine compartment module 30, water intake 36 formed in engine compartment module 30, engine mounting rail 130 with engine 200 mounted thereto disposed in engine compartment module 30 along with intake manifold 500 and exhaust pipe 600. A fuel container 175 which may be connected to the engine 200 may also be removably or permanently housed in the engine compartment module 30. Waterjet nozzle 400 extends from the rear of module 30 and is preferably mounted to engine compartment bulkhead 34. With further reference to FIG. 6E, steering linkage 300 and waterjet drive shaft 450 are also disposed in engine compartment module 30. The engine 200 may be removably mountable to the engine mounting rail 130.

Engine 200 may be any suitable engine such as but not limited to those commercially available from Subaru of America, Inc. of Cherry Hill, N.J. In one embodiment the engine is a Subaru EX21 7 hp engine.

Figure 7:
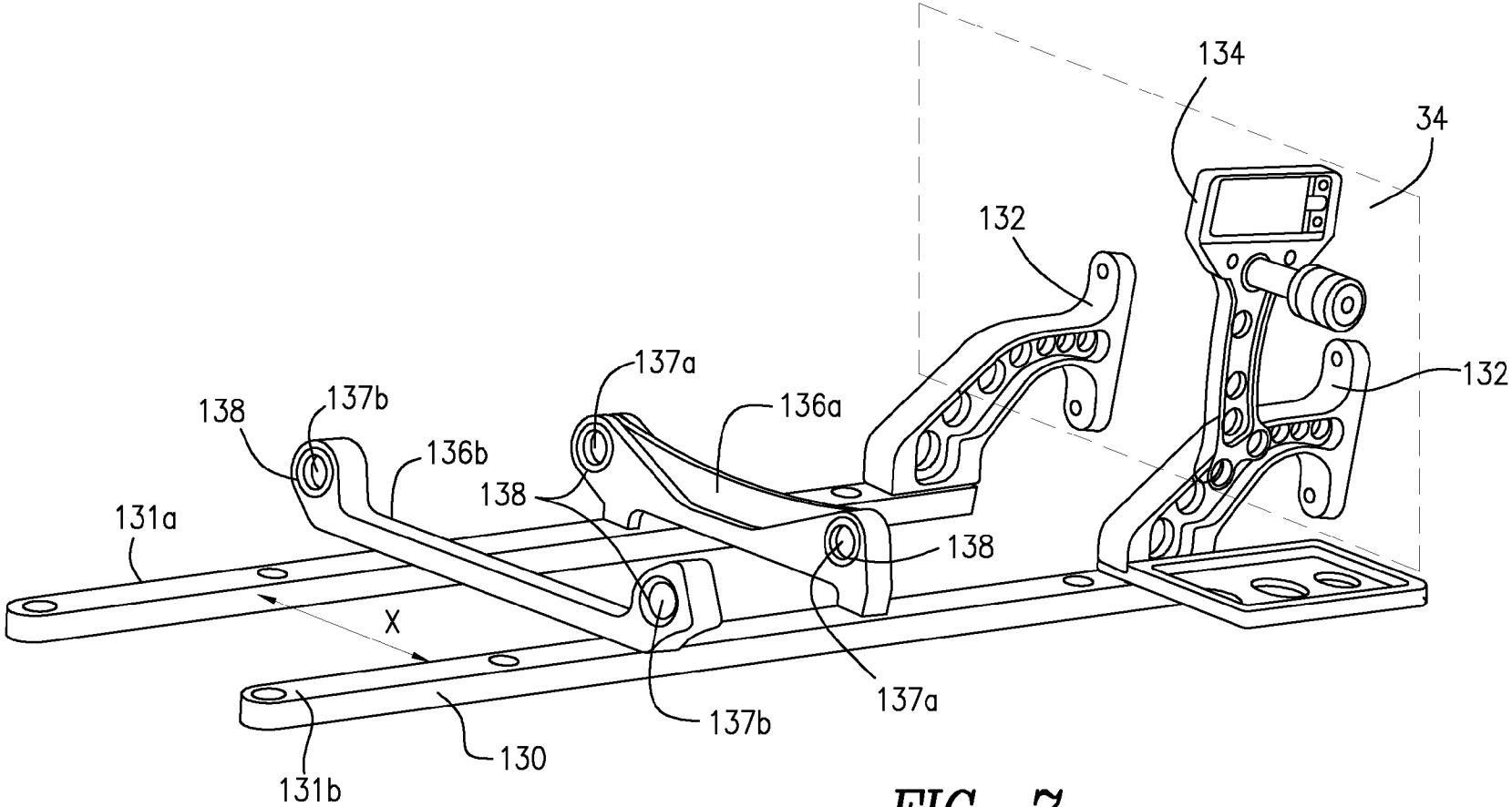
FIG. 7 is an elevated side perspective view of an engine mounting rail for a watercraft in accordance with an embodiment of the disclosed subject matter.

Now referring to FIG. 7, an engine mounting rail 130 includes engine mounting brackets 136*a*, 136*b* having apertures 137*a*, 137*b*, respectively. Engine mounting rail 130 may be fixed to an interior floor of engine compartment module 30 by any suitable fastening means including but not limited to screws, bolts, adhesive, etc. Engine mounting rail 130 may further include one or more bulkhead mounting brackets 132 fastenable to an engine compartment module bulkhead 34, and optionally a steering linkage bracket 134. In one embodiment, when the engine mounting rail 130 is fixed to the floor of engine compartment module 30 and bulkhead mounting brackets 132 are fixed to bulkhead 34, the engine mounting rail 130 serves to provide rigidity and strength to the engine compartment module 30. Rigidity in the engine compartment module 30 serves to reduce stress on the engine 200 and the connection between the engine 200, engine drive shaft 250 and waterjet drive shaft 450.

Figure 7A:
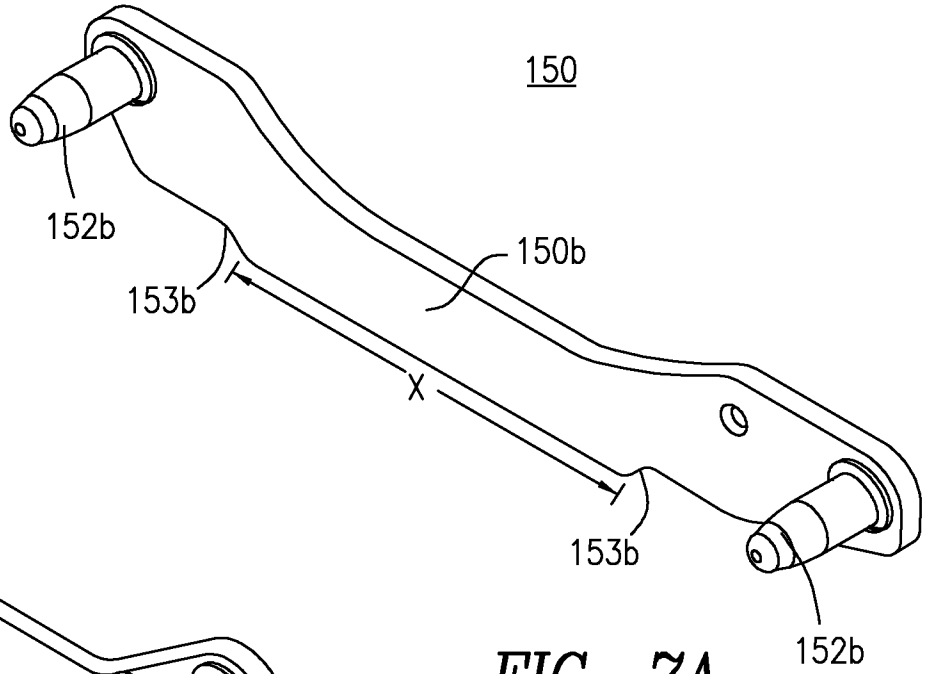
FIGS. 7A and 7B are elevated side perspective views of engine mounting pin assemblies for a watercraft in accordance with an embodiment of the disclosed subject matter.
Figure 7B:
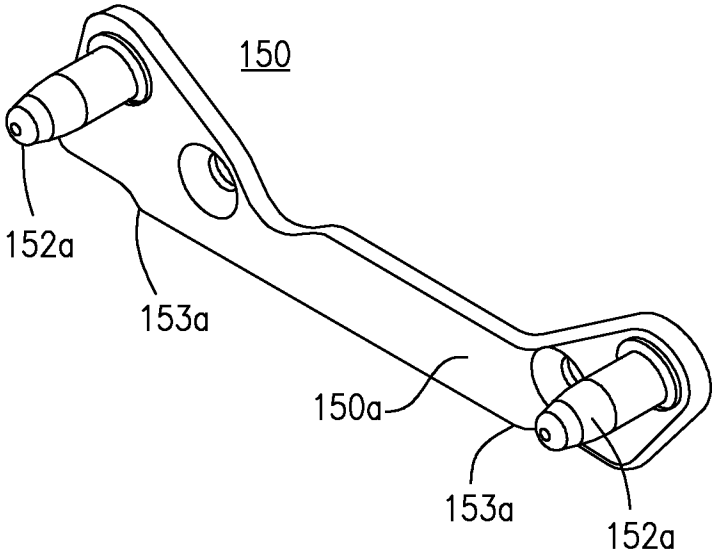
Figure 8:
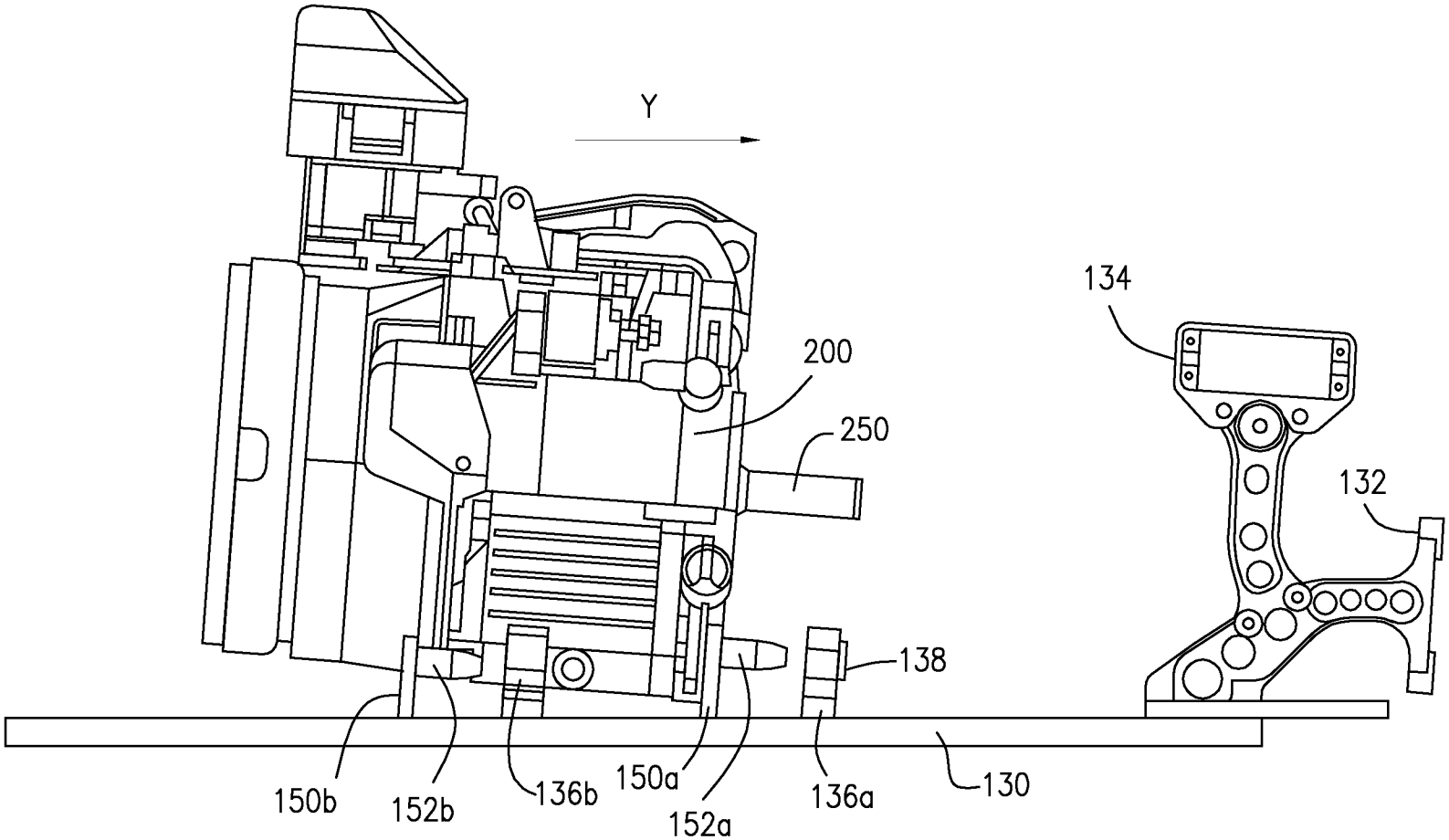
FIG. 8 is a side view of a mounting frame for a watercraft with an engine disposed in a position to be engaged to the mounting rail in accordance with an embodiment of the disclosed subject matter.

With further reference to FIG. 7A, an engine mounting pin assembly 150 includes brackets 150*a*, 150*b* and pin pairs 152*a* and 152*b*. The pins 152*a* and 152*a*, and 152*b* and 152*b*, respectively, are spaced apart and oriented to be aligned with apertures 137*a*, 137*b* to facilitate installation of engine 200. Brackets 150*a*, 150*b* further include pairs of alignment lips 153*a* and 153*b*, respectively. The distance between alignment lips 153*a* and 153*a*, and 153*b* and 153*b*, respectively, corresponds substantially to the distance X between the inside surfaces of parallel rails 131*a* and 131*b* as shown in FIG. 7 to facilitate installation of engine 200. With further reference to FIG. 8, mounting pin assembly 150 is connected to a bottom portion of engine 200 with pins 152*a*, 152*b* oriented in the direction of drive shaft 250 and brackets 150*a*, 150*b* spaced apart and substantially parallel. To install the engine 200 in engine compartment module 30, engine 200 is placed on engine mounting rail 130 such that pairs of alignment lips 153*a* and 153*b* are positioned along the inside of rails 131*a* and 131*b*, and pins 152*a*, 152*b* are aligned with apertures 137*a*, 137*b*, respectively. Sliding the engine in the direction shown by arrow Y, with further reference to FIG. 9, pins 152*a*, 152*b* are received in apertures 137*a*, 137*b*, respectively. When the engine 200 is mounted on the engine mounting rail 136, the engine 200 is effectively suspended. Thus, an engine mounting system is provided which is configured and operable to permit the engine 200 to be removed/installed in under one minute with no tools required. This feature provides advantages in ownership and serviceability of the watercraft. The system allows a user to place the engine 200 onto the rails 131*a*, 131, whereby the alignment lips 153*a*, 153*b* essentially automatically center and align the engine 200, and slide the engine 200 to the fully engaged position wherein the drive shaft 250 is connectable to the jet drive shaft 450, the pins 152*a*, 152*b* are received in apertures 137*a*, 137*b*, retaining the engine 200 in place during operation. In one embodiment, apertures 137*a*, 137*b* include bushings 138 and at least some of pins 152*a*, 152*b* are tapered so that as the engine 200 slides forward along the rails 131*a*, 131*b*, the tapered pins 152*a*, 152*b* begin to engage corresponding aligned bushings 138. As this occurs, the engine 200 is raised from the rails 131*a*, 131*b* and positioned into the 4 degree angle required to align the engine 200 with the jet drive shaft 450. Suspending the engine 200 allows the engine 200 to be used as a semi-stressed member to help increase the overall stiffness of the entire system, and extend the tie down points to the sides.

Figure 9:
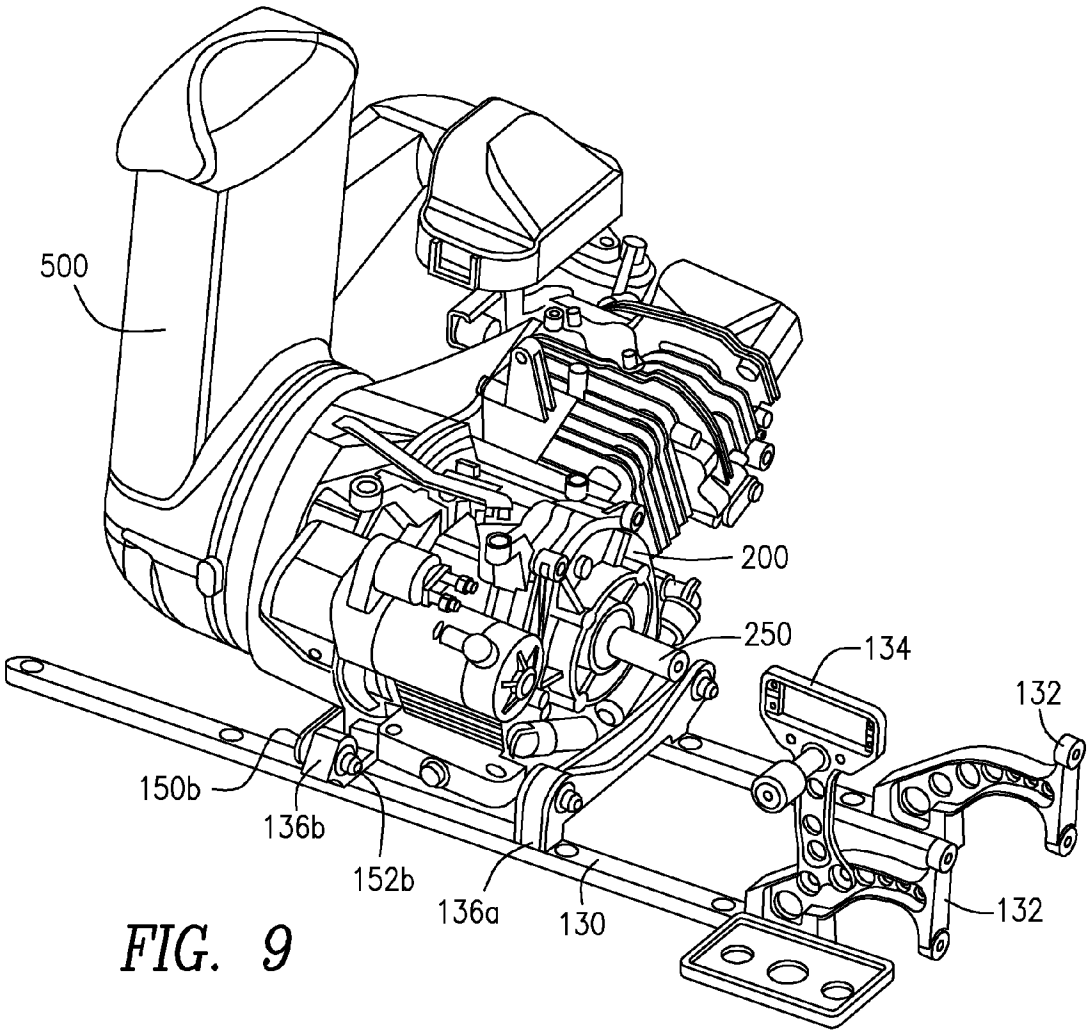
FIG. 9 is an elevated perspective view of a mounting rail for a watercraft with an engine disposed in an engaged position on the mounting rail in accordance with an embodiment of the disclosed subject matter.
Figure 10:
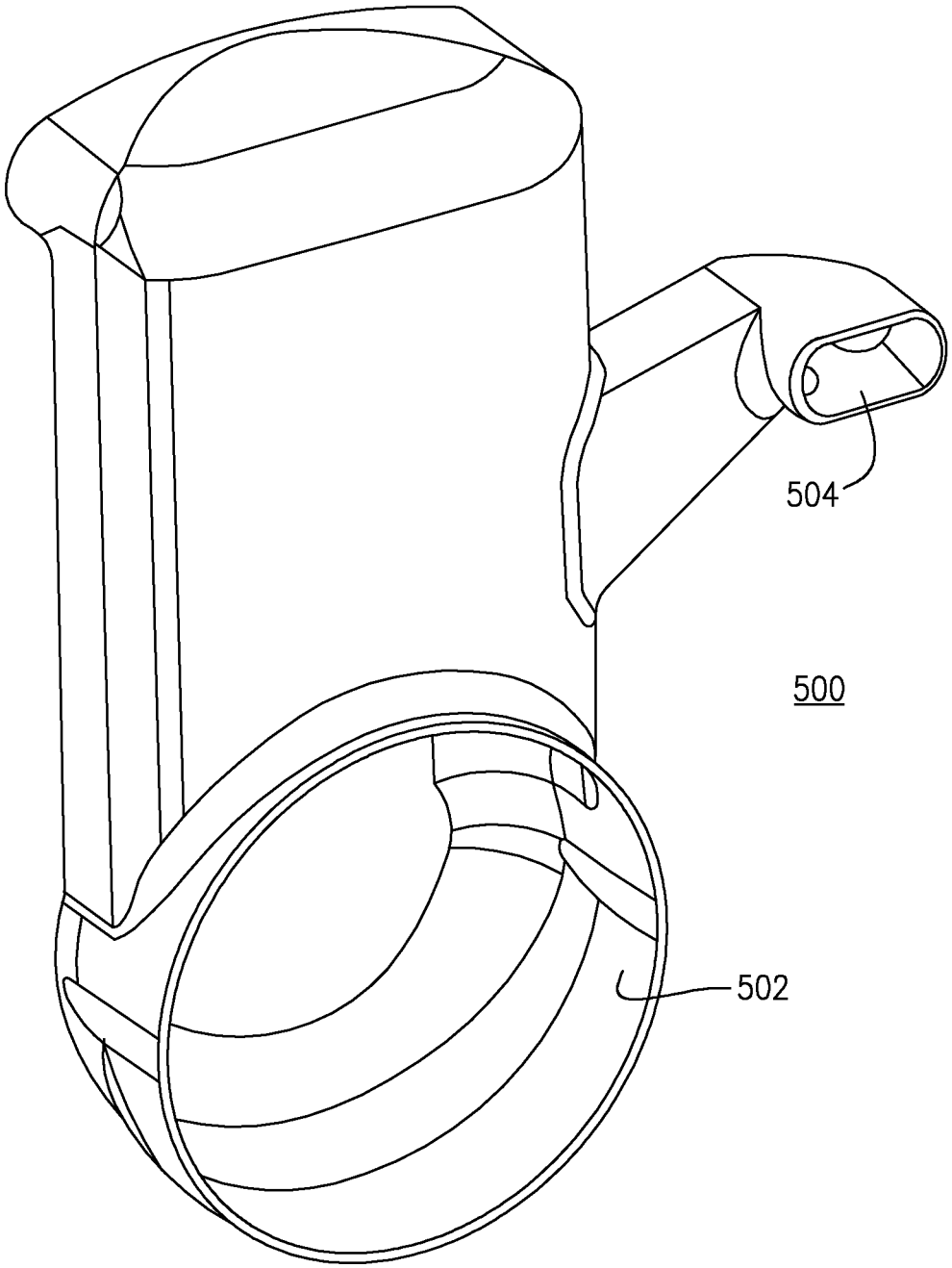
FIG. 10 is an elevated front perspective view of an intake manifold in accordance with an embodiment of the disclosed subject matter.
Figure 11:
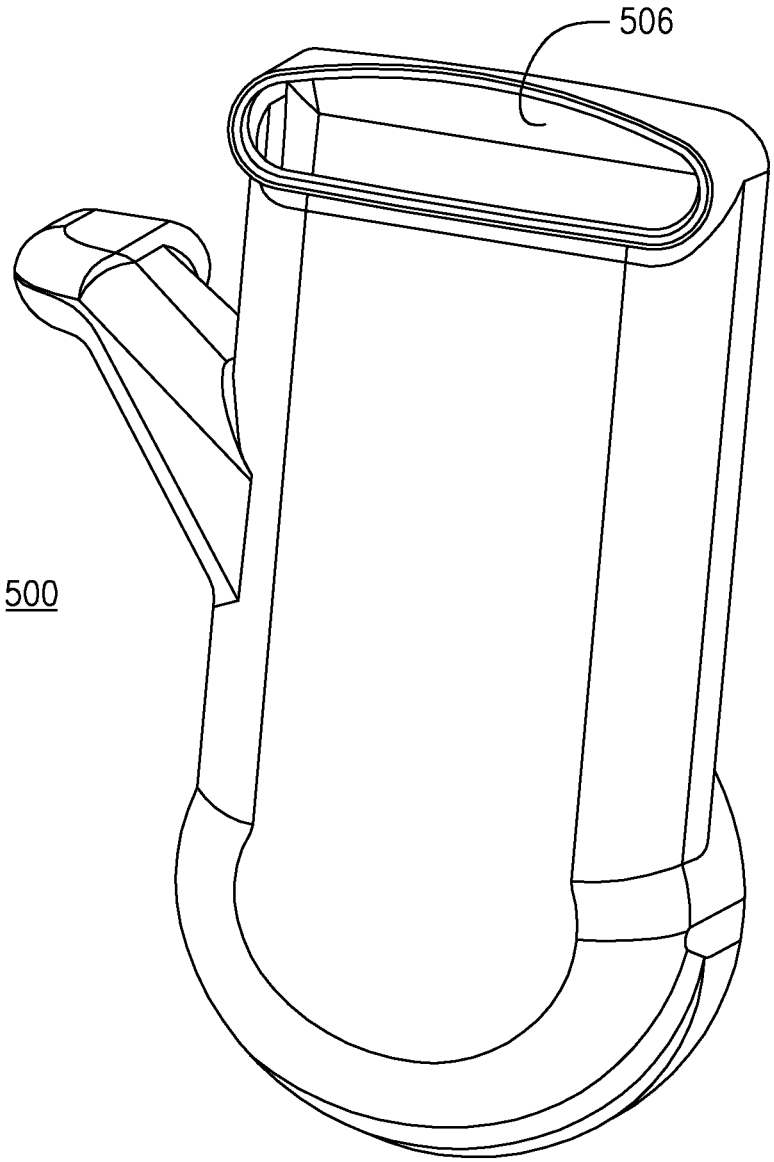
FIG. 11 is an elevated rear perspective view of an intake manifold in accordance with an embodiment of the disclosed subject matter.

Now referring to FIGS. 10 and 11, an intake manifold 500 includes engine connection openings 502 and 504 and intake opening 506. Intake manifold 500 is operable to be connected to engine 200 as depicted in FIGS. 6D and 9.

Figure 12:
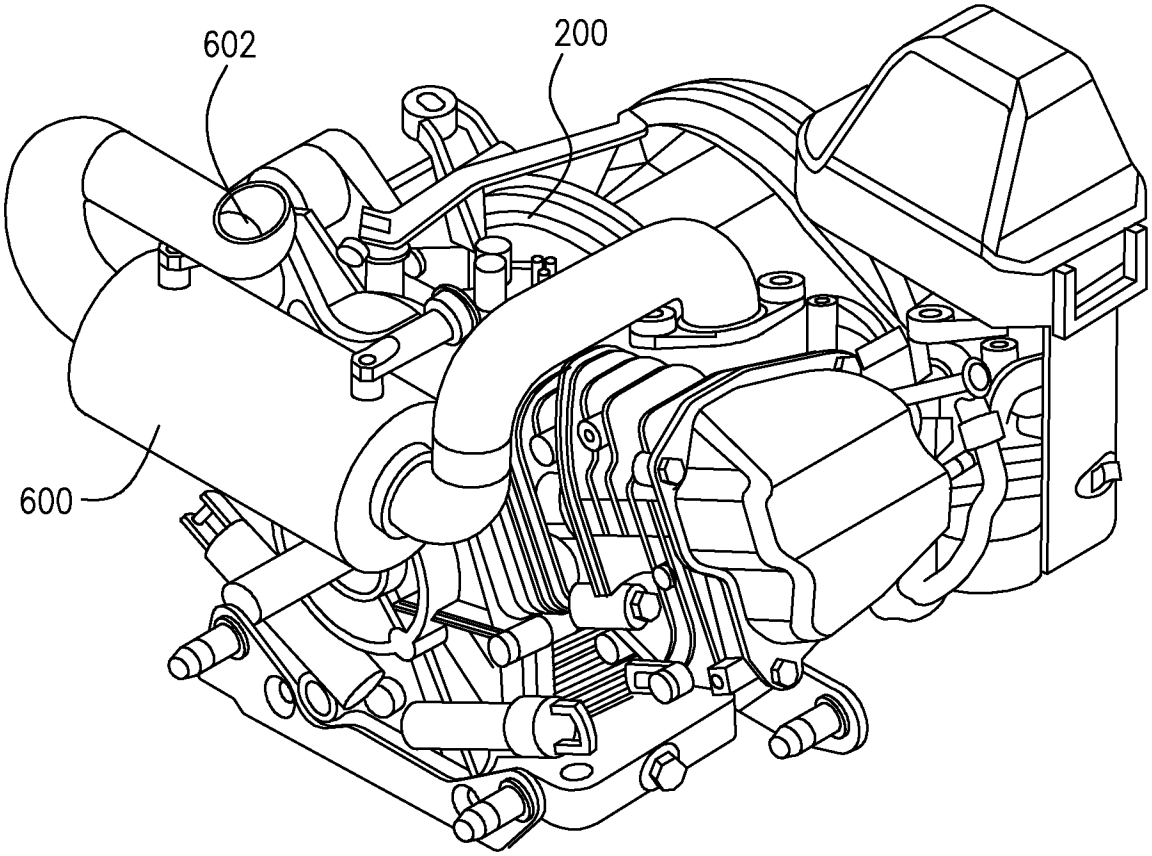
FIG. 12 is an elevated perspective view of a motor with an exhaust device connected thereto in accordance with an embodiment of the disclosed subject matter.
Figure 13:
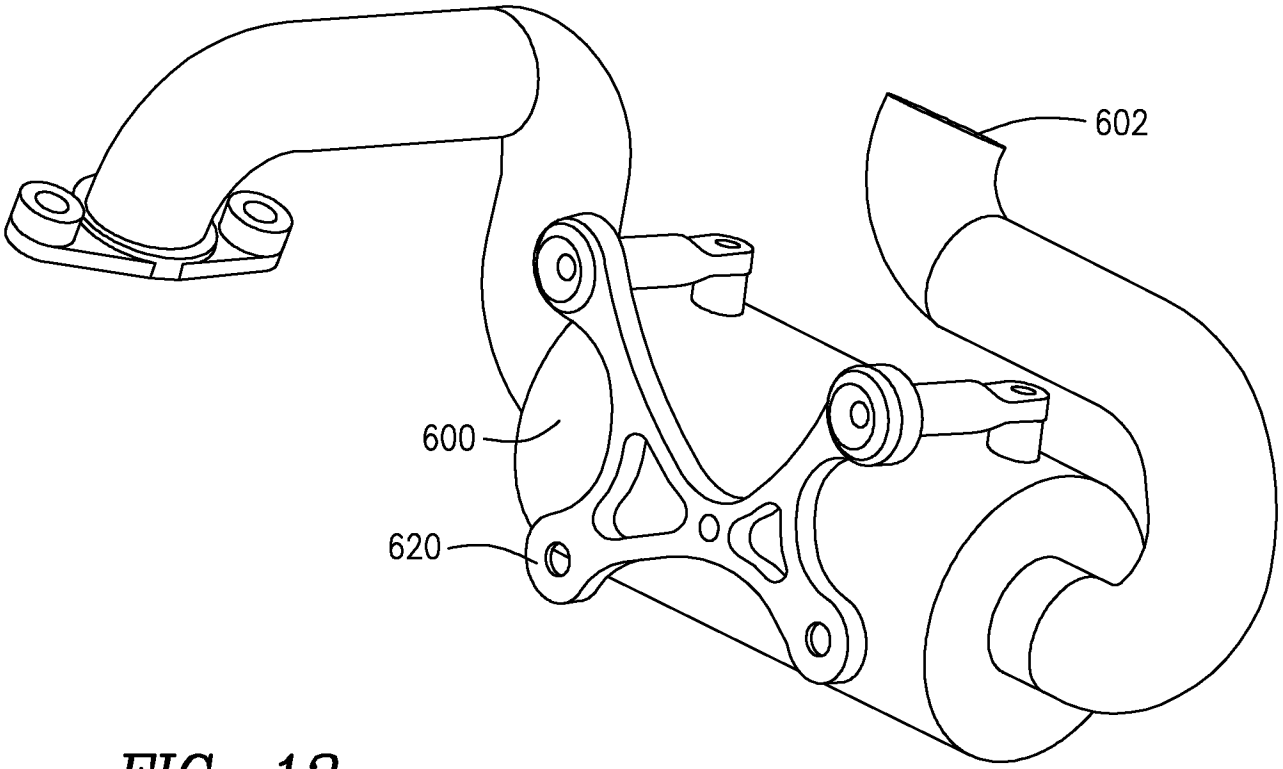
FIG. 13 is a perspective view of the exhaust device depicted in FIG. 12 along with mounting means in accordance with an embodiment of the disclosed subject matter.

Now referring to FIGS. 12 and 13, an exhaust pipe 600 having exhaust exit end 602 is shown. Exhaust pipe 600 is operable to be connected to engine 200 as shown. Exhaust opening 602 is preferably positioned adjacent a port 35 as shown in FIGS. 6C and 6D. Bracket 620 may be employed to securely mount exhaust pipe 600 to engine 200.

Figure 14:
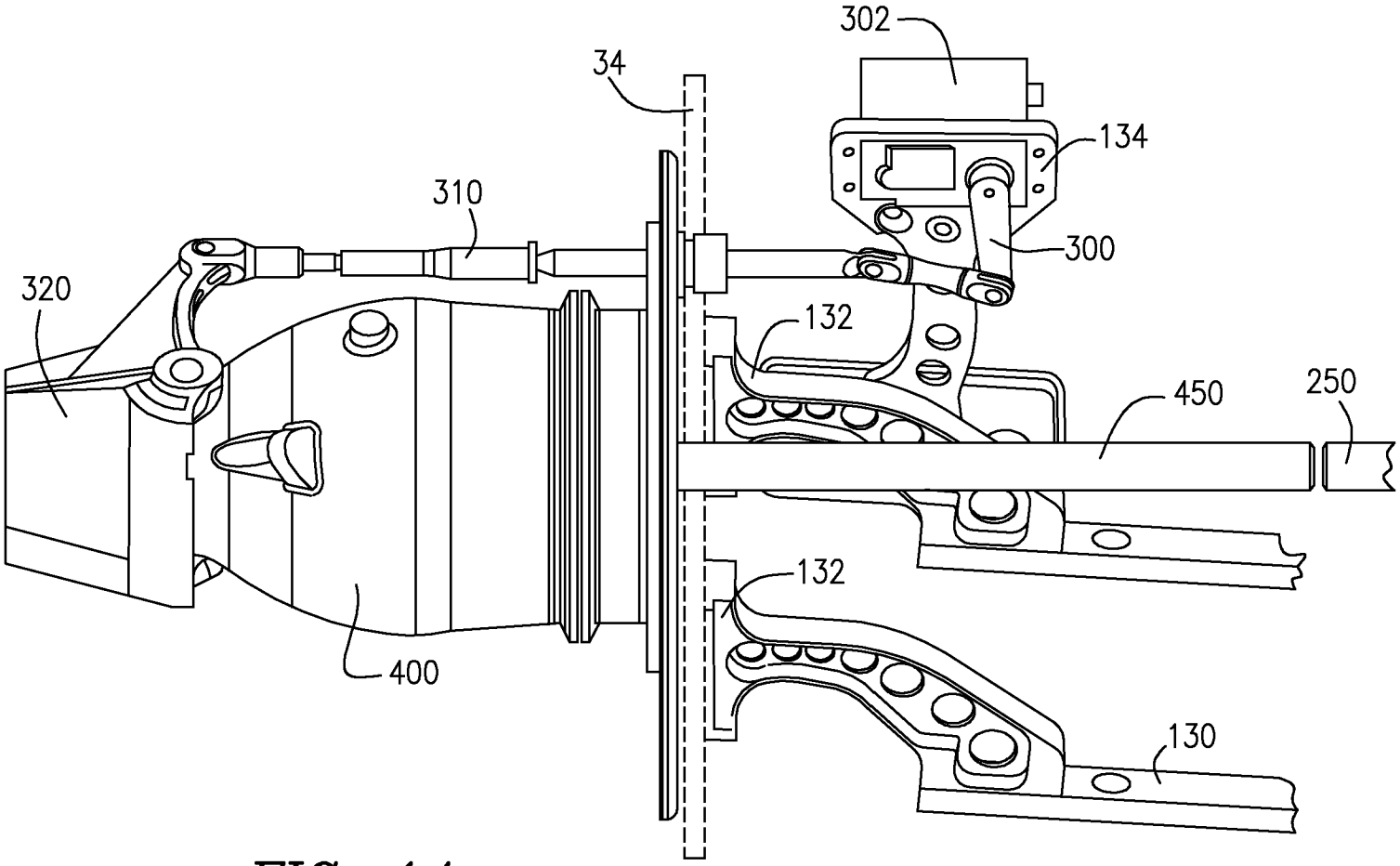
FIG. 14 is an elevated top perspective view of a steering device and water jet nozzle along with mounting means in accordance with an embodiment of the disclosed subject matter.

Now referring to FIG. 14, in one embodiment engine mounting rail 130 includes steering linkage bracket 134 operable to receive a steering arm 300 operably linked through one or more steering linkages 310, a steering module 302 operable to be linked to a steering cable or the like (not shown) and steering wheel. In one embodiment steering module 302 is a servo motor electrically wired to a control such as a joystick, steering wheel or the like for steering control. Steering linkages 310 are operably connected to a steering nozzle 320. Engine mounting rail also further includes bulkhead mounting brackets 132 mounted to bulkhead 34 (in phantom). Jet drive shaft 450 is in alignment with engine drive shaft 250. As will be apparent to the skilled artisan the drive shafts 250 and 450 may be operably linked by devices old and well-known in the art.

It may be desirable to include convenient means for electrically connecting the modules disclosed herein. For example, in some embodiments one or more servo motors located in one module may be employed to control for example throttle and steering, the controls for which may be located in a separate module. With reference to FIG. 15 in one embodiment engine compartment module bulkhead 32 may include electrical connectors 710 and 720 fixed thereto. Electrical connectors 710 and 720 may be any suitable commercially available connectors designed for use with bulkheads, such as those available from Amphenol Tuchel Electronics GmbH of Heilbrunn, Germany through Allied Electronics of Fort Worth, Tex. For example connector 710 may be a female connector such as Allied Electronics Part No. 70013151 and connector 720 may be a male connector such as Allied Electronics Part No. 70013182, or vice versa. Alternatively, both connectors 710, 720 could be male connectors or female connectors.

Figure 15A:
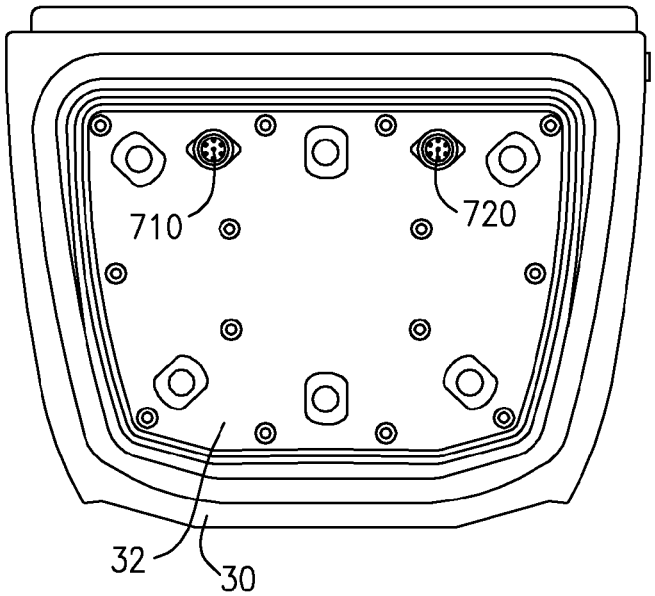
FIG. 15A is a front view of an engine compartment module bulkhead in accordance with one embodiment of the of the disclosed subject matter.
Figure 15B:
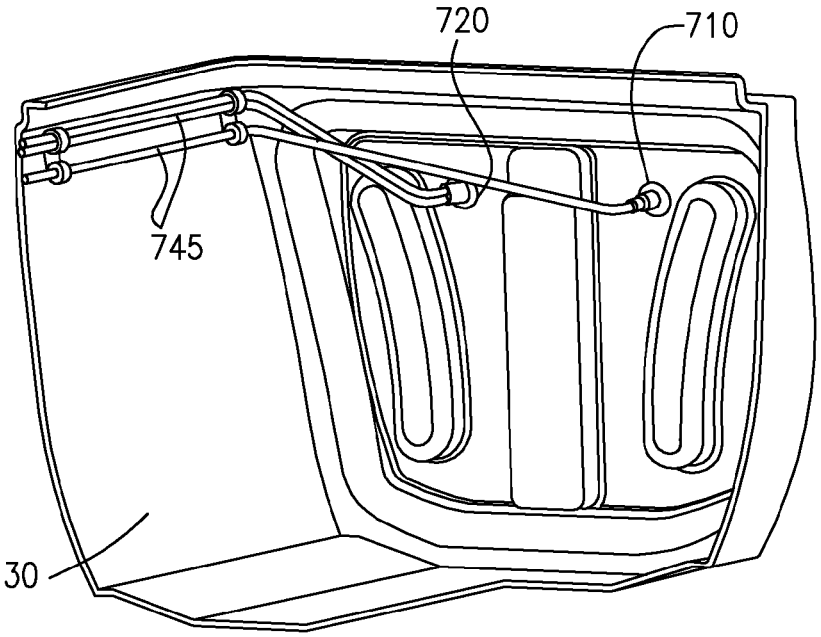
FIG. 15B is a cutaway side perspective view of an interior front side of an engine compartment module including electrical wiring and wiring harness in accordance with one embodiment of the disclosed subject matter.
Figure 15C:
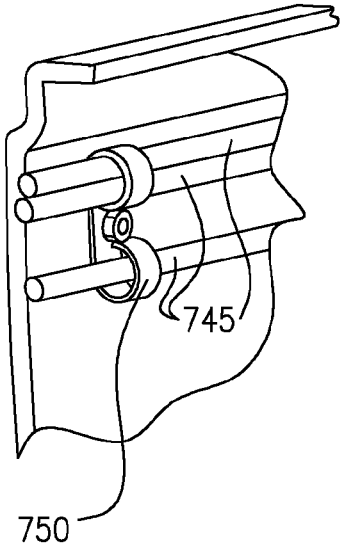
FIG. 15C is an enlarged view of detail E of FIG. 15B.

Now referring to FIGS. 15B and 15C, the opposite ends of connectors 710, 720 are shown on the interior front side of the engine compartment module 30 with wiring 745 extending therefrom, and wiring harness 750 mounted to the interior of the module 30. Wiring 745 may be connected to a servo motor, charging system, engine, etc. contained in the engine compartment 30.

Figure 15D:
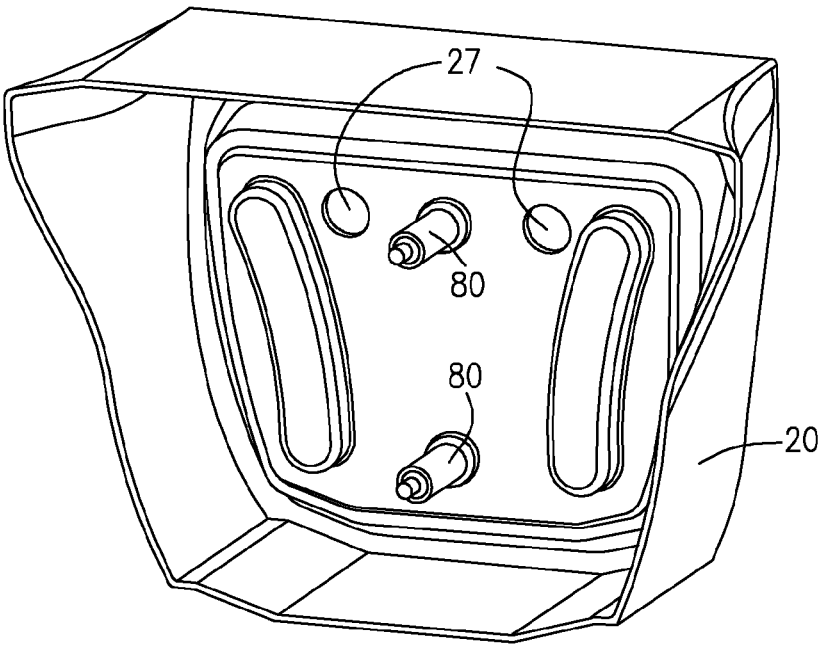
FIG. 15D is a cutaway perspective view of a rear interior portion of a cockpit module in accordance with one embodiment of the disclosed subject matter.
Figure 15E:
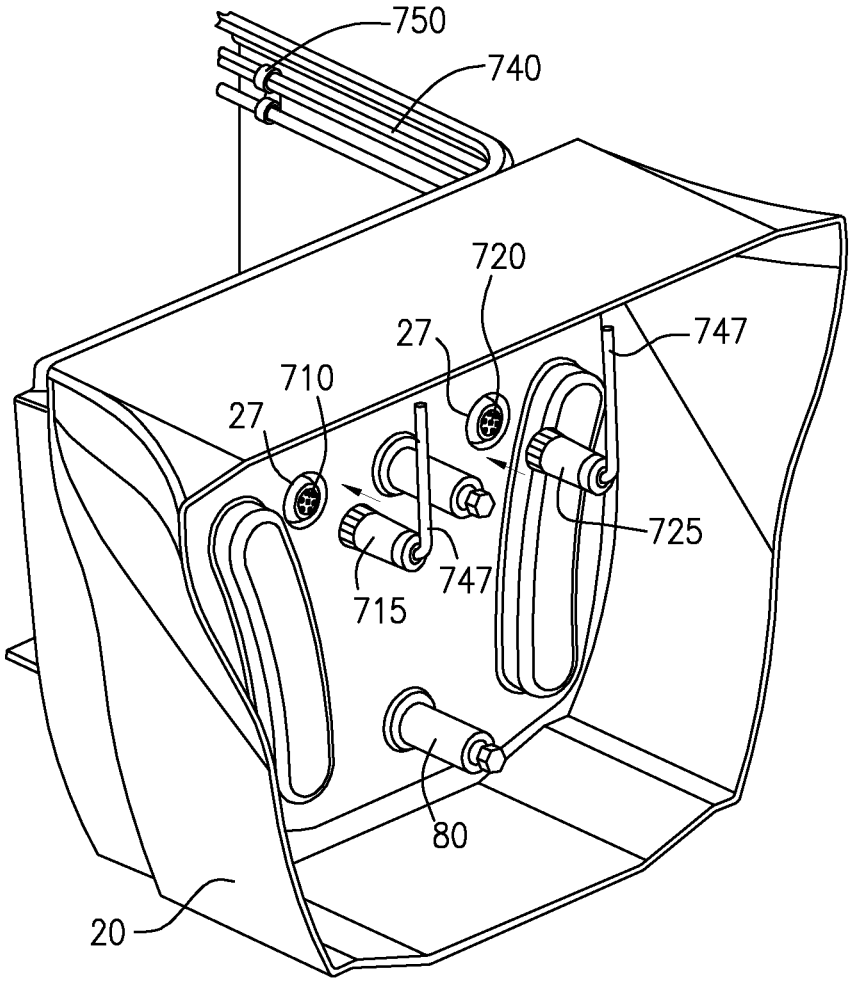
FIG. 15E is a cutaway perspective view of a rear interior portion of a cockpit module adjacent a front portion of an engine compartment module, with electrical connectors depicted, in accordance with one embodiment of the disclosed subject matter.

Now referring to FIG. 15D, cockpit module 20 may include apertures 27 alignable with the connectors 710, 720 of engine compartment module 30. With further reference to FIG. 15E, the cockpit module 20 is shown adjacent the engine compartment module 30 such that apertures 27 are aligned in register with connectors 710 and 720. Electrical connector 715 is connectable to electrical connector 710 and electrical connector 725 is connectable to electrical connector 720. Electrical connectors 710 and 720 may be any suitable commercially available connectors designed for use with bulkheads, such as those available from Amphenol Tuchel Electronics GmbH of Heilbrunn, Germany through Allied Electronics of Fort Worth, Tex. For example connector 715 may be a male connector such as Allied Electronics Part No. 70013135 and connector 725 may be a female connector such as Allied Electronics Part No. 70013166, or vice versa, depending on the corresponding connector 710, 720. Alternatively, both connectors 715, 725 could be male connectors or female connectors. Wiring 747 may be mounted to a wiring harness on the interior of cockpit module 20 and connected to a control device operable to control a servo motor, charging system, engine, etc. which may be located in the engine compartment module 30. It will be apparent to those skilled in the art wiring 745, 747 may be mounted to the hull in positions out of direct sight and/or in positions calculated to prevent damage to the wiring.

Embodiments of the electrical connection schemes exemplified above provide convenient means to complete modular assembly including electrical connectivity. In one embodiment, employing opposite connectors in adjacent modules (e.g., one being male to female, the other being female to male) ensures a user cannot cross the two circuits in which a possible short/malfunction could occur. For example, one circuit formed by corresponding connectors may operate one or more servo motors, and the other circuit may operate the engine and charging system.

It will be apparent to those skilled in the art that the positions of male and female connectors, conduit wiring and wiring harnesses may be altered from what is depicted herein, depending on the configuration of the modules, bulkheads, controls, etc.

In one embodiment, watercraft as disclosed in U.S. Pat. No. 6,247,422 entitled PLANING WATERCRAFT HULL AND PROPULSION SYSTEM, the entirety of which is incorporated herein by reference, are modified in accordance with the teachings herein.

Although the apparatus and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A modular watercraft hull comprising a bow module having a bow at a first end and a bulkhead disposed on a second end opposite the bow, a cockpit module having a first end comprising a bulkhead and a second end opposite the cockpit module first end comprising a bulkhead, wherein the first end of the cockpit module is removably connectable to the second end of the bow module, and an engine compartment module comprising a first end having a bulkhead, wherein the engine compartment first end is removably connectable to the second end of the cockpit module and wherein the engine compartment module comprises a second end opposite the first end, the engine compartment second end comprising a bulkhead, wherein each of said bulkheads is non-integral to the module to which it is fastened, and is formed from a rigid material independently selected from the group consisting of metals, polymers and ceramics, and is mounted to said modules via inserts molded into said modules, or by adhesive, screws or bolts, or by any combination thereof.

2. The modular watercraft hull of claim 1 wherein the bow module bulkhead comprises at least one male element operable to engage a female element disposed on the first end bulkhead of the cockpit module.

3. The modular watercraft hull of claim 1 wherein the bow module bulkhead comprises at least one female element operable to engage a make element disposed on the first end bulkhead of the cockpit module.

4. The modular watercraft hull of claim 1 wherein the cockpit module second end bulkhead comprises at least one male element operable to engage a female element disposed on the first end bulkhead of the engine compartment module.

5. The modular watercraft hull of claim 1 wherein the cockpit module second end bulkhead comprises at least one female element operable to engage a male element disposed on the first end bulkhead of the engine compartment module.

6. A modular watercraft hull comprising a bow module having a bow at a first end and a rigid non-integral bulkhead disposed on a second end opposite the bow, a cockpit module having a first end comprising a rigid non-integral bulkhead and a second end opposite the cockpit module first end comprising a rigid non-integral bulkhead, wherein the first end of the cockpit module is removably connectable to the second end of the bow module, and an engine compartment module comprising a first end having a rigid non-integral bulkhead, wherein the engine compartment first end is removably connectable to the second end of the cockpit module, wherein the bow module bulkhead comprises at least one latch assembly comprising at least one pin and a handle, wherein the pin is operable to engage at least one pin-receiving housing disposed on the first end of the cockpit module.

7. A modular watercraft hull comprising a bow module having a bow at a first end and a rigid non-integral bulkhead disposed on a second end opposite the bow, a cockpit module having a first end comprising a rigid non-integral bulkhead and a second end opposite the cockpit module first end comprising a rigid non-integral bulkhead, wherein the first end of the cockpit module is removably connectable to the second end of the bow module, and an engine compartment module comprising a first end having a rigid non-integral bulkhead, wherein the engine compartment first end is removably connectable to the second end of the cockpit module, wherein the bow module bulkhead comprises at least one spool disposed thereon, whereon the at least one spool is operable to engage a channel disposed on the first end of the cockpit module.

8. The modular watercraft hull of claim 6 wherein the bow module bulkhead comprises at least one spool disposed thereon, wherein the at least one spool is operable to engage a channel disposed on the first end of the cockpit module.

9. The modular watercraft hull of claim 1 wherein the cockpit module second end bulkhead comprises at least one fastener comprising a bolt, wherein the bolt is operable to engage at least one bolt receiver disposed on the first end of the engine compartment module.

10. The modular watercraft hull of claim 9 wherein the cockpit module second end bulkhead comprises at least one guide pin, wherein the guide pin is operable to engage at least one pin receiver disposed on the first end of the engine compartment module.

11. The modular watercraft hull of claim 1 wherein the engine compartment module comprises an engine mounting system comprising rails disposed on an interior bottom surface of the engine compartment module, the rails oriented in substantial axial alignment with a long axis of the engine compartment module, at least one bracket extending from the rails and oriented perpendicular to and spanning the rails, the at least one bracket operable to receive connecting means engaged to an engine.

12. The modular watercraft hull of claim 11 wherein the engine mounting system further comprises at least one further bracket extending from at least one of the rails in a direction toward the second end of the engine compartment module, the at least one further bracket operable to be attached to the engine compartment module bulkhead.

13. The modular watercraft hull of claim 11 wherein the engine mounting system further comprises at least one bracket operable to be fixed to an engine to be mounted, the bracket comprising at least two pins oriented and spaced from each other to be aligned with apertures formed in the at least one bracket extending from the rails.

14. The modular watercraft hull of claim 1 wherein the cockpit module is sized and configured to contain the bow module and the engine compartment module.

15. A system comprising a modular watercraft of claim 1 and an engine, wherein the engine is removably mountable in the engine compartment module.

16. The modular watercraft hull according to claim 1 wherein said bulkheads are formed from aluminum.

17. The modular watercraft hull according to claim 1 wherein said bow module second end bulkhead and said cockpit module first end bulkhead are substantially identical in profile, and said cockpit module second end bulkhead and said engine compartment module first end bulkhead are substantially identical in profile.

18. The modular watercraft hull according to claim 1 wherein said modules are thermoformed or rotomolded plastic.

19. A modular watercraft hull comprising:

a bow module having a bow at a first end and a rigid non-integral bulkhead disposed on a second end opposite the bow;

a cockpit module having a first end comprising a rigid non-integral bulkhead and a second end opposite the cockpit module first end comprising a rigid non-integral bulkhead, wherein the first end of the cockpit module is removably connectable to the second end of the bow module; and, an engine compartment module comprising a first end having a rigid non-integral bulkhead, wherein the engine compartment first end is removably connectable to the second end of the cockpit module, wherein the cockpit module bulkhead comprises at least one latch assembly comprising at least one pin and a handle, wherein the pin is operable to engage at least one pin-receiving housing disposed on the first end of the bow module.

20. A modular watercraft hull comprising:

a bow module having a bow at a first end and a rigid non-integral bulkhead disposed on a second end opposite the bow;

a cockpit module having a first end comprising a rigid non-integral bulkhead and a second end opposite the cockpit module first end comprising a rigid non-integral bulkhead, wherein the first end of the cockpit module is removably connectable to the second end of the bow module, and;

an engine compartment module comprising a first end having a rigid non-integral bulkhead, wherein the engine compartment first end is removably connectable to the second end of the cockpit module, wherein the cockpit module bulkhead comprises at least one spool disposed thereon, whereon the at least one spool is operable to engage a channel disposed on the first end of the bow module.

* * * * *